US011613914B2

(12) United States Patent
Maki

(10) Patent No.: US 11,613,914 B2
(45) Date of Patent: Mar. 28, 2023

(54) ADJUSTABLE HATCH COVER LOCKS

(71) Applicant: Ireco, LLC, Elmhurst, IL (US)

(72) Inventor: Brian G. Maki, Wood Dale, IL (US)

(73) Assignee: Ireco, LLC, Elmhurst, IL (US)

( * ) Notice: Subject to any disclaimer, the term of this patent is extended or adjusted under 35 U.S.C. 154(b) by 257 days.

(21) Appl. No.: 16/777,982

(22) Filed: Jan. 31, 2020

(65) Prior Publication Data

US 2021/0238889 A1 Aug. 5, 2021

(51) Int. Cl.

| | |
|---|---|
| ***E05B 63/00*** | (2006.01) |
| ***E05B 83/02*** | (2014.01) |
| ***E05B 65/00*** | (2006.01) |
| ***B61D 39/00*** | (2006.01) |
| ***E05C 3/02*** | (2006.01) |
| ***B61D 7/00*** | (2006.01) |

(52) U.S. Cl.

CPC ..... *E05B 63/0056* (2013.01); *B61D 39/001* (2013.01); *E05B 65/006* (2013.01); *E05B 83/02* (2013.01); *E05C 3/02* (2013.01); *B61D 7/00* (2013.01); *E05Y 2900/51* (2013.01)

(58) Field of Classification Search

CPC ..... Y10T 292/1075; Y10T 292/0886; Y10T 292/0887; Y10T 292/089; Y10T 292/0911; Y10T 292/0913; Y10T 292/0914; Y10T 292/0917; Y10T 292/20; Y10T 292/202; Y10T 292/225; E05B 63/0056; E05B 65/006; E05B 83/02; B61D 39/001; B61D 7/00; E05Y 2900/51; E05C 3/00; E05C 3/002; E05C 3/004; E05C 3/02; E05C 3/04; E05C 3/041; E05C 3/044; E05C 3/045; E05C 3/06; E05C 3/10; E05C 5/00; E05C 5/02; B65D 45/00; B65D 45/02; B65D 45/04; B65D 45/06; B65D 45/16; B65D 45/20; B65D 45/24; B65D 45/32; B65D 45/34; B65D 90/10; F16J 13/00; F16J 13/02; F16J 13/06; F16J 13/16; Y10S 292/11; Y10S 292/49

See application file for complete search history.

(56) References Cited

U.S. PATENT DOCUMENTS

| | | | | |
|---|---|---|---|---|
| 504,292 | A * | 8/1893 | Badoni | E05B 55/005 70/448 |
| 3,601,437 | A * | 8/1971 | Lyons | F24F 7/02 292/108 |
| 3,659,886 | A * | 5/1972 | Andrews | E05C 19/024 292/78 |

(Continued)

*Primary Examiner* — Kristina R Fulton
*Assistant Examiner* — Steven A Tullia
(74) *Attorney, Agent, or Firm* — Cook Alex Ltd.

(57) ABSTRACT

A hatch lock cover includes inner and outer flanges, with a keeper and a handle positioned between the flanges. The handle is rotatable with respect to the flanges to move a batten bar contacting surface into and out of engagement with a batten bar or a hatch cover tab of a hatch cover. A downwardly extending portion of an arm of the keeper may define an aperture and/or include a projection for securing an adjustment plate or extension piece to the arm to provide an alternative batten bar contacting surface. Alternatively, a mounting bracket may be provided to secure the hatch cover lock to a railcar, with the mounting bracket accommodating the hatch cover lock in different positions having different elevations. Such configurations allow the hatch cover lock to be adjusted for use with a batten bar or hatch cover tab having a gasket that has become worn out.

12 Claims, 25 Drawing Sheets

(56) References Cited

U.S. PATENT DOCUMENTS 3,804,026 A * 4/1974 McNally ..... B65D 90/54 292/210
3,848,912 A 11/1974 Jensen et al.
3,874,716 A * 4/1975 Bancroft ..... E05B 65/08 70/DIG. 52
4,021,067 A * 5/1977 Nadherny ..... E05C 5/00 292/256.5
4,057,020 A * 11/1977 Halliar ..... F16J 13/18 292/257
4,063,764 A * 12/1977 Adler ..... F16J 13/18 292/DIG. 4
4,076,290 A * 2/1978 Sweger ..... E05C 3/044 292/256.5
4,141,520 A * 2/1979 Beijer ..... B64C 9/00 292/173
4,326,395 A * 4/1982 DeRosa ..... H02B 1/063 70/168
4,365,832 A * 12/1982 Treppler ..... B63B 19/24 292/259 R
5,314,218 A * 5/1994 Nadherny ..... E05C 3/30 292/259 R
5,488,808 A * 2/1996 Cahill ..... E04B 2/7425 52/584.1
5,489,130 A * 2/1996 Clark ..... E05B 65/0021 292/DIG. 36
5,785,362 A * 7/1998 Nadherny ..... B61D 7/24 292/124
5,911,664 A * 6/1999 Masters ..... E04C 2/428 52/584.1
6,039,362 A * 3/2000 Nadherny ..... E05C 3/008 292/124
6,951,318 B1 * 10/2005 Petersen ..... E05C 3/16 244/114 R
8,240,742 B2 * 8/2012 Lowak ..... B60J 7/20 296/76
2005/0127260 A1 * 6/2005 Dittmer ..... F16M 11/041 248/221.11
2016/0177604 A1 * 6/2016 Ring ..... E05B 83/363 292/188
2017/0241171 A1 * 8/2017 Seki ..... E05D 11/06

* cited by examiner 50
10
18
70
62
20
80
24
26
54
12
76L
68
66
76c
72
52
74
78L
68

ADJUSTABLE HATCH COVER LOCKS

BACKGROUND

Field of the Disclosure

The present disclosure relates to hatch cover locks. More particularly, the present disclosure relates to adjustable hatch cover locks.

Description of Related Art

Covered hopper railcars are used to carry a variety of commodities, such as grain, plastic pellets, cement, etc. The top of a covered hopper railcar will typically have openings through which the commodity is loaded. Once loaded, a hatch cover (which is typically hinged on one side) is closed over the opening (or a portion of the opening, if several hatch covers are associated with a single opening) and secured with a hatch cover lock. A conventional hatch cover lock 10 is shown in FIGS. 1-3, with FIG. 1 showing the hatch cover lock 10 in an unlocked condition and FIGS. 2 and 3 showing the hatch cover lock 10 in a locked condition.

The hatch cover lock 10 includes an inner flange or housing 12, a keeper 14 positioned outwardly of the inner flange 12, a handle 16 positioned outwardly of the keeper 14, and an outer flange or housing 18 positioned outwardly of the handle 16. The inner flange 12 is secured with respect to the outer flange 18, which may include the two flanges 12 and 18 being secured to each other or both flanges 12 and 18 being secured to the same surface or some other suitable arrangement that renders the flanges 12 and 18 immobile with respect to the top of the associated railcar. The keeper 14 and handle 16 are trapped between the two flanges 12 and 18, but may be moved with respect to each other and with respect to the flanges 12 and 18, as will be described.

A pivot member 20 (which may be configured similarly to a bolt) extends through aligned circular openings of the inner flange 12, the handle 16, and the outer flange 18. The pivot member 20 also extends through an L-shaped opening 22 defined in the keeper 14 (FIGS. 1 and 3). By such a configuration, the handle 16 is allowed to rotate about the pivot member 20 with respect to the (stationary) flanges 12 and 18, while the keeper 14 is free to both rotate and translate with respect to the pivot member 20.

The surface of the handle 16 facing the keeper 14 includes a projection 24 that is also received by the L-shaped opening 22 of the keeper 14, as shown in FIGS. 1 and 3. By such a configuration, the handle 16 may be rotated or pivoted about the pivot member 20, with rotation of the handle 16 being transmitted to the keeper 14 via the projection 24.

Opposing ends of the keeper 14 include a follower 26 and an arm 28, both of which extend in the direction of the inner flange 12. The follower 26 is received within a slot 30 of the inner flange 12, which slot 30 has an arcuate section 32 and a linear section 34. When the hatch cover lock 10 is in its unlocked condition (FIG. 1), the follower 26 is positioned at an end 36 of the arcuate section 32. A 90° rotation of the handle 16 about the pivot member 20 will cause 90° rotation of the keeper 14 in the same direction with the handle 16, which moves the follower 26 all of the way through the arcuate section 32 of the slot 30, to the point 38 where the arcuate section 32 meets the linear section 34 of the slot 30. An additional 90° rotation of the handle 16 about the pivot member 20 in the same direction will result in the follower 26 moving into and (downwardly) through the linear section 34 of the slot 30, to the end or bottom 40 of the linear section 34, placing the hatch cover lock 10 in its closed condition (FIGS. 2 and 3).

The above-described rotation of the handle 16 and resulting movement of the keeper 14 will move a surface 42 of the arm 28 of the keeper 14 (which surface is referred to herein as the "batten bar contacting surface") into contact with a batten bar or hatch cover tab associated with the hatch cover. So contacting the batten bar or hatch cover tab with the batten bar contacting surface 42 will compress a gasket between the inside of the hatch cover and a coaming of the railcar, thereby sealing the hatch cover over the opening of the railcar. The hatch cover may be subsequently opened by 180° rotation of the handle 16 from its position in the closed condition of FIGS. 2 and 3 to its position in the open condition of FIG. 1, which disengages the batten bar contacting surface 42 from the batten bar or hatch cover tab and allows the hatch cover to be opened. A locking pawl 44 (FIG. 2) may be provided to lock the handle 16 in the closed condition, with the locking pawl 44 needing to be actuated before the handle 16 may be rotated back to its open condition.

One issue that may be encountered during service is that the gasket may become worn out over time and not provide a sufficient seal between the hatch cover and the railcar coaming, thus allowing rain or debris to enter the railcar and damage the commodity. One solution to this problem is to replace the gasket with a new one. However, a replacement gasket may not be readily available at the time or place where it is required. Another approach has been to reconfigure the arm 28 of the keeper 14, as in U.S. Pat. No. 3,848,912, which is hereby incorporated herein by reference. In the conventional keeper configuration, the arm 28 has an inwardly extending portion 46 and a downwardly extending portion 48, with the batten bar contacting surface 42 being located at the bottom end of the downwardly extending portion 48. The keeper of U.S. Pat. No. 3,848,912 has only an inwardly extending portion, with a vertically oriented bore that receives a screw or bolt. The bottom end of the screw or bolt serves as a batten bar contacting surface. In the event that the gasket has become worn out, the position of the screw or bolt within the bore may be adjusted (by moving the screw or bolt downwardly within the bore), which effectively lowers the batten bar contacting surface to compensate for the lower height of the batten bar or hatch cover tab.

SUMMARY

There are several aspects of the present subject matter which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In one aspect, a hatch cover lock for use in combination with a hatch cover of a railcar includes an inner flange defining an opening and a slot. The hatch cover lock further includes an outer flange defining an opening at least partially aligned with the opening of the inner flange, along with a keeper at least partially positioned between the inner and outer flanges, adjacent to the inner flange. The keeper includes a follower at least partially received within the slot of the inner flange, with the keeper defining an opening at least partially aligned with the openings of the inner and outer flanges. The hatch cover lock also includes a handle at least partially positioned between the keeper and the outer flange. The handle includes a projection at least partially received within the opening of the keeper, with the handle defining an opening at least partially aligned with the openings of the inner flange, the outer flange, and the keeper. A pivot member extends through the openings of the inner flange, the outer flange, the keeper, and the handle, with the handle and the keeper being configured for rotation about the pivot member with respect to the inner and outer flanges between an open condition and a closed condition. The keeper includes an arm having an inwardly extending portion and a downwardly extending portion, with a bottom end of the downwardly extending portion defining a batten bar contacting surface configured to contact a batten bar or a hatch cover tab of a hatch cover in the closed condition. The downwardly extending portion of the arm of the keeper defines at least one aperture configured to receive at least one fastener or protrusion for securing an adjustment plate or extension piece to the downwardly extending portion of the arm of the keeper so as to provide an alternative batten bar contacting surface and/or includes at least one projection configured to be received by at least one aperture defined in the adjustment plate or extension piece for securing the adjustment plate or extension piece to the downwardly extending portion of the arm of the keeper so as to provide the alternative batten bar contacting surface.

In another aspect, a system for locking and unlocking a hatch cover of a railcar includes a hatch cover lock and a mounting bracket. The hatch cover lock includes an inner flange defining an opening and a slot. The hatch cover lock further includes an outer flange defining an opening at least partially aligned with the opening of the inner flange, along with a keeper at least partially positioned between the inner and outer flanges, adjacent to the inner flange. The keeper includes a follower at least partially received within the slot of the inner flange, with the keeper defining an opening at least partially aligned with the openings of the inner and outer flanges. The hatch cover lock also includes a handle at least partially positioned between the keeper and the outer flange. The handle includes a projection at least partially received within the opening of the keeper, with the handle defining an opening at least partially aligned with the openings of the inner flange, the outer flange, and the keeper. A pivot member extends through the openings of the inner flange, the outer flange, the keeper, and the handle, with the handle and the keeper being configured for rotation about the pivot member with respect to the inner and outer flanges between an open condition and a closed condition. The keeper includes an arm having an inwardly extending portion and a downwardly extending portion, with a bottom end of the downwardly extending portion defining a batten bar contacting surface configured to contact a batten bar or a hatch cover tab of a hatch cover in the closed condition. The mounting bracket is configured to be secured to a railcar and to the hatch cover lock, with the mounting bracket being configured to accommodate the hatch cover lock in a plurality of different positions having different elevations.

These and other aspects of the present subject matter are set forth in the following detailed description of the accompanying drawings.

DESCRIPTION OF THE ILLUSTRATED EMBODIMENTS

The embodiments disclosed herein are for the purpose of providing a description of the present subject matter, and it is understood that the subject matter may be embodied in various other forms and combinations not shown in detail. Therefore, specific designs and features disclosed herein are not to be interpreted as limiting the subject matter as defined in the accompanying claims.

Figure 1:
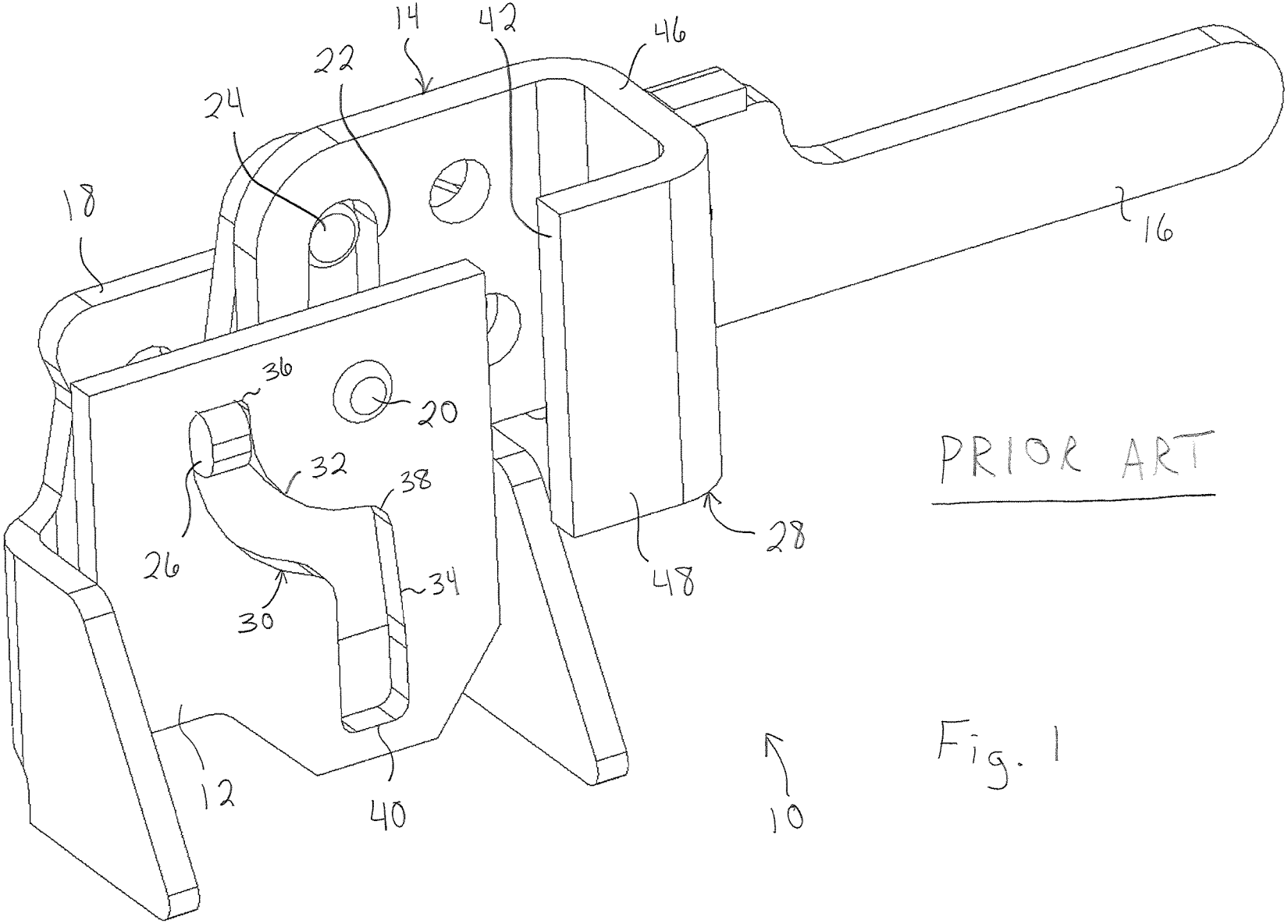
PRIOR ART Fig. 1
FIG. 1 is a perspective view of a hatch cover lock according to conventional design, in an unlocked or open condition.
Figure 2:
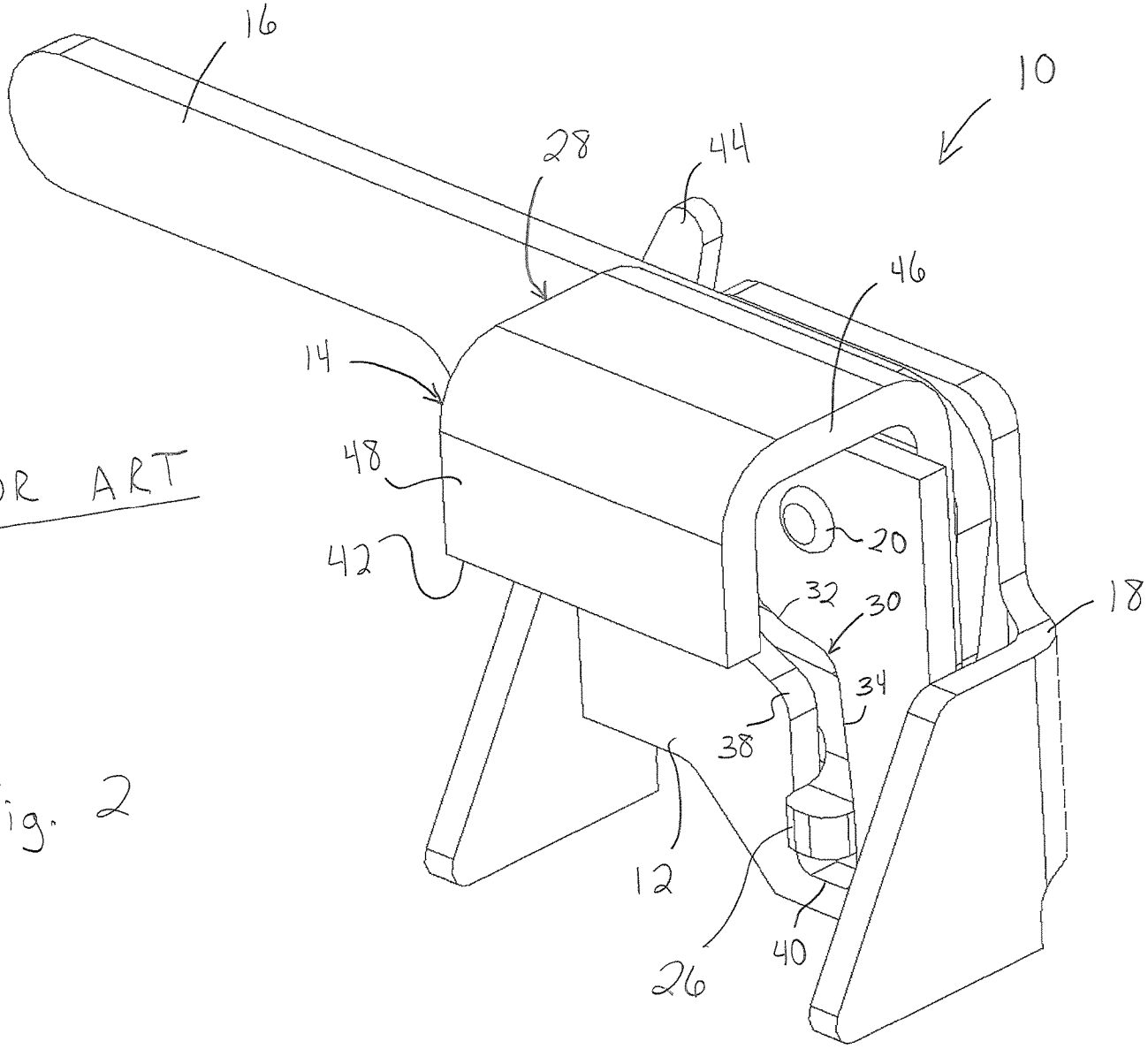
PRIOR ART Fig. 2
FIGS. 2 and 3 are perspective views of the hatch cover lock of FIG. 1, in a locked or closed condition.
Figure 3:
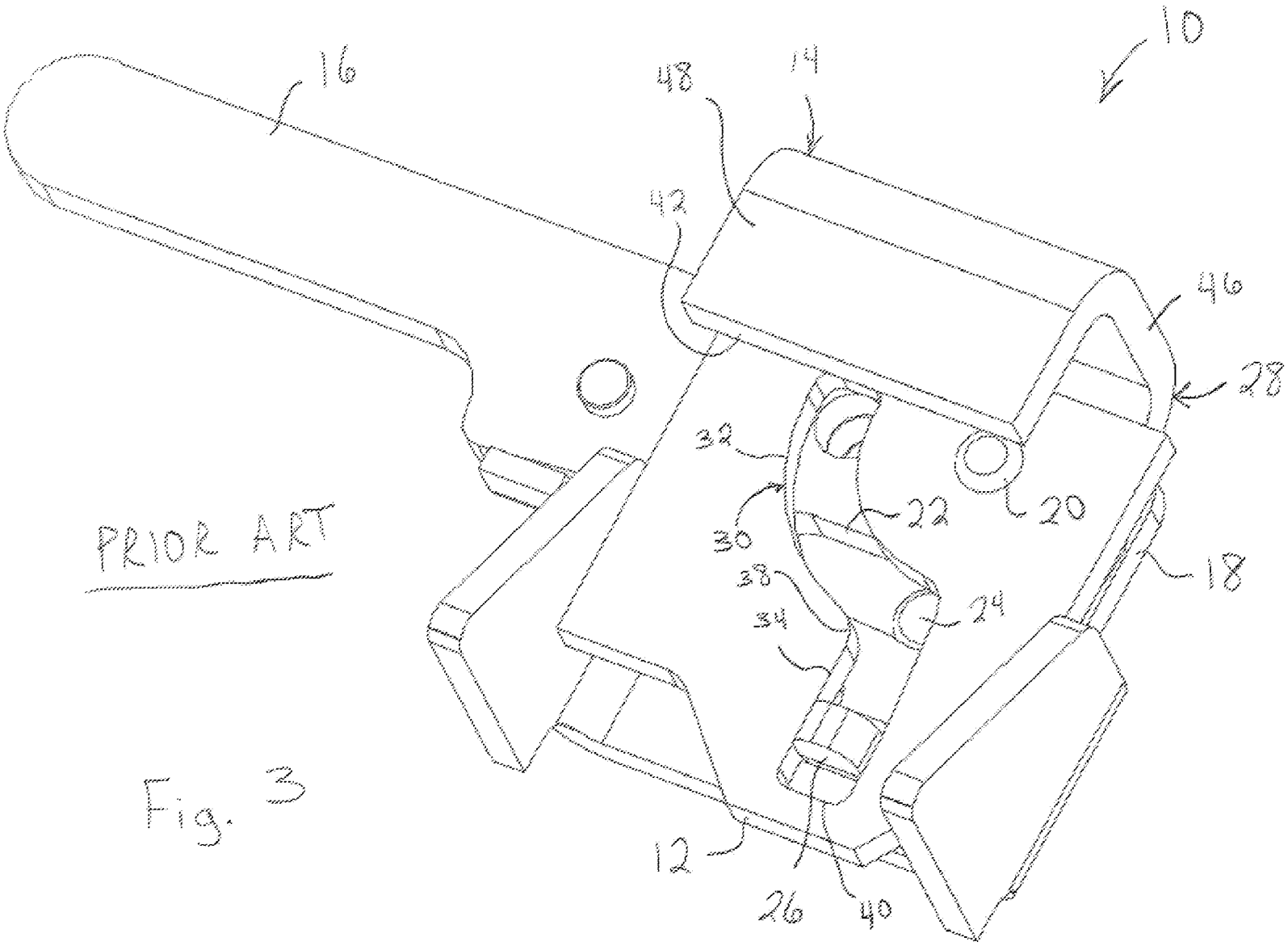
PRIOR ART Fig. 3

FIGS. 4-17 show different embodiments of adjustable hatch cover locks according to aspects of the present disclosure and components thereof. The adjustable hatch cover locks of FIGS. 4-17 employ adjustment plates or extension pieces to provide a hatch cover lock (e.g., one of the type described above and shown in FIGS. 1-3) with an alternative batten bar contacting surface that is lower than the existing batten bar contacting surface in order to compensate for the lower height of a batten bar or hatch cover tab having an associated gasket that has become worn out. The hatch cover locks of FIGS. 4-17 are similarly configured to the conventional hatch cover lock 10 of FIGS. 1-3, so the components of the adjustable hatch cover locks of FIGS. 4-17 that are configured according to conventional design will not be described in detail herein. Rather, only the differences between the conventional design and the illustrated adjustable hatch cover locks described herein will be explained.

It will be appreciated that, due to the adjustable hatch cover locks of FIGS. 4-17 being similarly configured to the conventional design, a conventional hatch cover lock 10 may be retrofitted to accommodate an adjustment plate or extension piece according to the present disclosure. Alternatively, a conventional hatch cover lock may be replaced with an adjustable hatch cover lock according to the present disclosure when providing a new railcar, as adjustable hatch cover locks of the type described herein may be used in combination with a batten bar or hatch cover tab having a new gasket or a worn gasket. The adjustable hatch cover lock may be simply provided without the associated adjustment plate or extension piece, with the adjustment plate or extension piece being provided later in time, if the gasket of the associated batten bar or hatch cover tab has become worn out.

Figure 4:
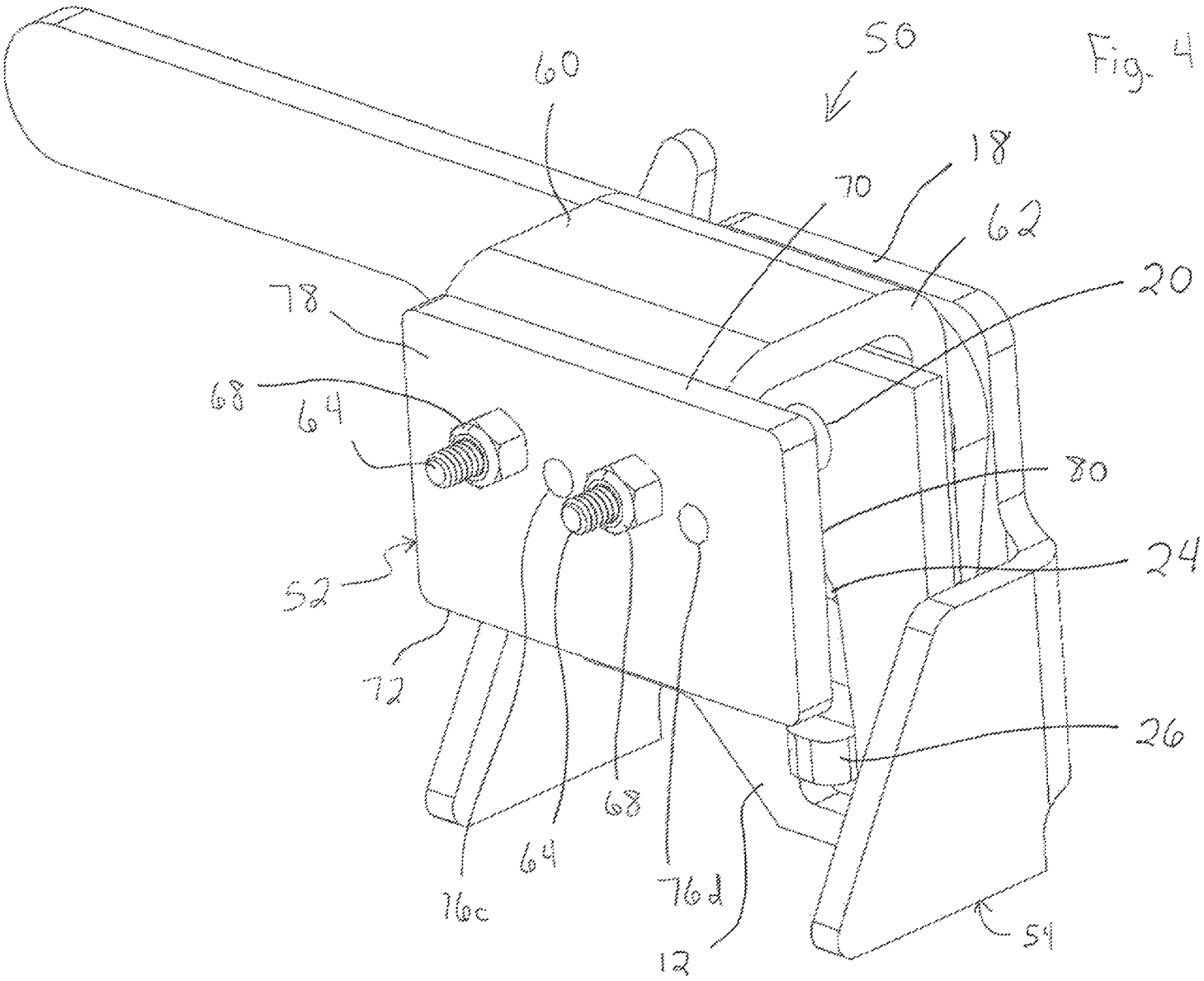
FIG. 4 is a perspective view of an exemplary hatch cover lock according to an aspect of the present disclosure.
Figure 5:
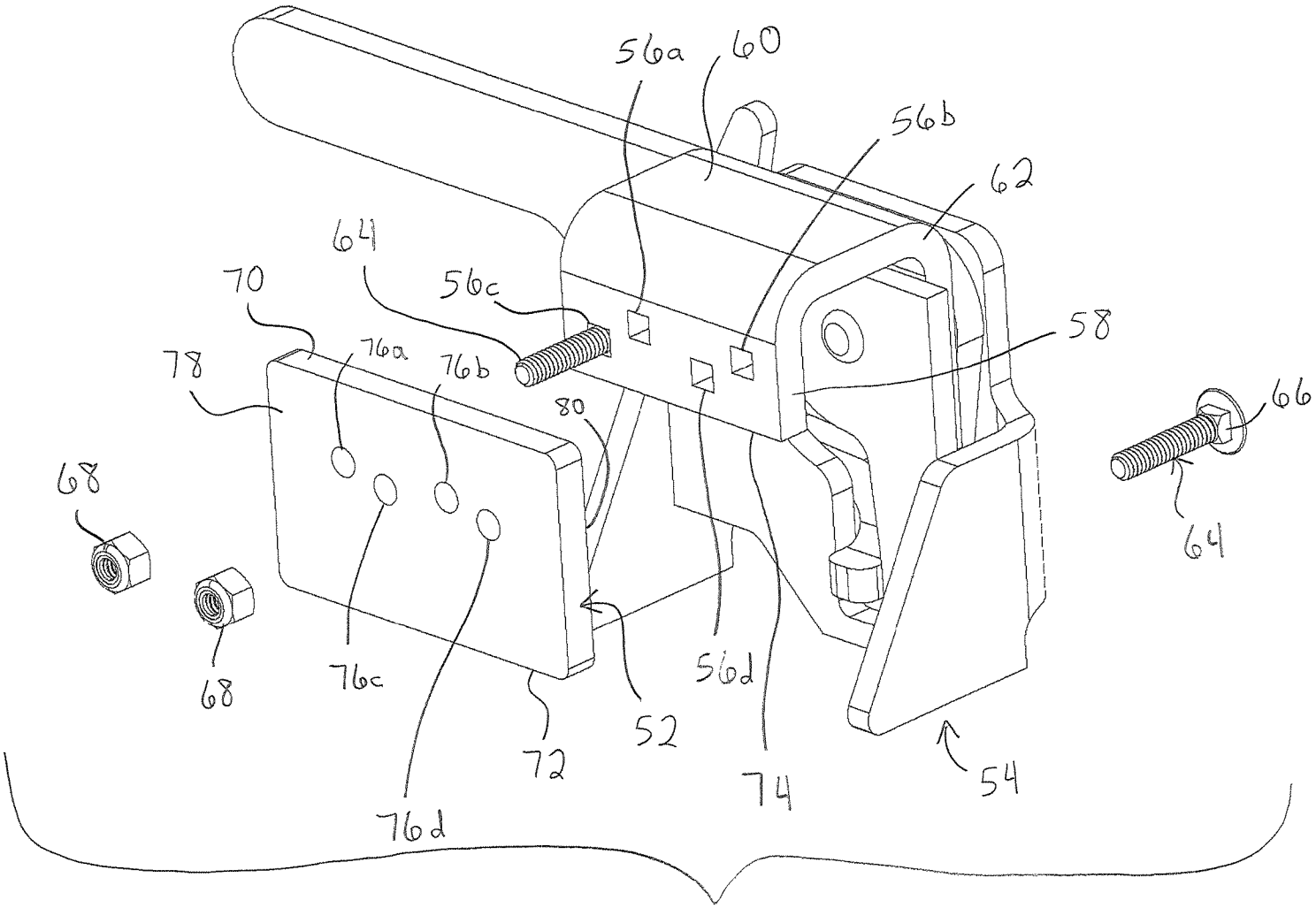
FIG. 5 is an exploded view of the hatch cover lock of FIG. 4.

Turning now to the individual adjustable hatch cover locks, FIGS. 4 and 5 show an adjustable hatch cover lock 50 comprising an adjustment plate 52 secured to a hatch cover lock 54. The illustrated hatch cover lock 54 is provided according to conventional design, except that at least one aperture 56 is defined in the downwardly extending portion 58 of the arm 60 of the keeper 62 (FIG. 5). The arm of a keeper of a newly installed hatch cover lock may be provided with an aperture of the type shown in FIG. 5 or the arm of an existing keeper may be modified to include at least one aperture (e.g., using a drill or the like).

The aperture 56 receives at least one fastener 64 or a protrusion of the adjustment plate 52 to secure the adjustment plate 52 to the downwardly extending portion 58 of the arm 60 of the keeper 62. The apertures 56 are shown in FIG. 5 as being square holes to accommodate the square shoulder 66 of a fastener 64 configured as a carriage bolt (with associated nut 68), but it should be understood that the apertures 56 and fasteners 64 may be differently configured without departing from the scope of the present disclosure.

The adjustment plate 52 has an upper surface 70 and a lower surface 72, with the lower surface 72 (in the orientation of FIGS. 4 and 5) facing downwardly to provide an alternative batten bar contacting surface. The alternative batten bar contacting surface is preferably positioned at a lower elevation than the batten bar contacting surface 74 of the arm 60 of the keeper 62, which allows the alternative batten bar contacting surface to be used in combination with a batten bar or hatch cover tab having an associated gasket that has become worn out.

While it is preferable for the alternative batten bar contacting surface to be positioned at a lower elevation than the batten bar contacting surface 74, it should be understood that it is within the scope of the present disclosure for the adjustment plate 52 to be associable to the keeper 62 in at least one orientation that positions the alternative batten bar contacting surface at the same elevation as the batten bar contacting surface 74 or even at a higher elevation than the batten bar contacting surface 74. Such a configuration would allow for the adjustment plate 52 to be associated to the keeper 62 without interfering with engagement between the batten bar contacting surface 74 and a batten bar or hatch cover tab. This may be advantageous if the adjustment plate 52 is to be provided as a precautionary measure, which is associated to the keeper 62 before the gasket of an associated batten bar or hatch cover tab has become worn out. While the gasket remains intact, the adjustment plate 52 allows for normal interaction between the batten bar contacting surface 74 and the batten bar or hatch cover tab. Upon the gasket becoming sufficiently worn, the adjustment plate 52 may be reconfigured or reoriented (as will be described in greater detail herein) to place the alternative batten bar contacting surface at a lower elevation than the batten bar contacting surface 74, thereby allowing the alternative batten bar contacting surface to instead be used in combination with the batten bar or hatch cover tab.

FIGS. 4 and 5 show an embodiment in which four apertures 56*a*-56*d* are defined in the downwardly extending portion 58 of the arm 60 of the keeper 62 (FIG. 5), with two fasteners 64 (each received in a different aperture 56) being used to secure the adjustment plate 52 to the keeper 62. It may be advantageous to use two or more fasteners or two or more protrusions or the combination of at least one fastener and at least one protrusion to prevent the adjustment plate 52 from rotating or moving with respect to the keeper 62, though it is within the scope of the present disclosure for a single fastener or protrusion to be employed.

It will be seen that two of the apertures 56*a* and 56*b* are provided at a higher level than the other two apertures 56*c* and 56*d*. The two rows of apertures 56 are illustrated as being laterally offset, rather than being positioned in vertical alignment, but it is within the scope of the present disclosure for the rows of apertures 56 to be vertically aligned. By providing upper and lower rows of apertures 56, an adjustment plate 52 may be secured to the keeper 62 in multiple positions. More particularly, a pair of fasteners 64 may be received by the upper apertures 56*a* and 56*b* and a pair of apertures 76 of the adjustment plate 52 to secure the adjustment plate 52 to the keeper 62 in a first position. A pair of fasteners 64 may instead be received by the lower apertures 56*c* and 56*d* and the same pair of apertures 76 of the adjustment plate 52 to secure the adjustment plate 52 to the keeper 62 in a second position. The second position places the alternative batten bar contacting surface at a lower elevation than the first position, so it may be the case that the first position is used when the gasket of a batten bar or hatch lock tab is partially worn, while the second position is used at a later time when the gasket is more worn.

Just as the downwardly extending portion 58 of the arm 60 of the keeper 62 may be provided with multiple rows of apertures 56, the adjustment plate 52 may also be provided with multiple rows of apertures 76. In the embodiment of FIGS. 4 and 5, the adjustment plate 52 includes a row of upper apertures 76*a* and 76*b* and a row of lower apertures 76*c* and 76*d*. The two rows of apertures 76 are illustrated as being laterally offset, rather than being positioned in vertical alignment, but it is within the scope of the present disclosure for the rows of apertures 76 to be vertically aligned. Providing upper and lower rows of apertures 76 allows for the adjustment plate 52 to be secured to the keeper 62 in even more positions. More particularly, a pair of fasteners 64 may be received by the upper apertures 76*a* and 76*b* and a pair of apertures 56 of the keeper 62 to secure the adjustment plate 52 to the keeper 62 in a third position. A pair of fasteners 64 may instead be received by the lower apertures 76*c* and 76*d* and the same pair of apertures 56 of the keeper 62 to secure the adjustment plate 52 to the keeper 62 in a fourth position. The fourth position places the alternative batten bar contacting surface at a higher elevation than the third position, so it may be the case that the fourth position is used when the gasket of a batten bar or hatch lock tab is partially worn, while the third position is used at a later time when the gasket is more worn.

It will be seen that the apertures 76 of the adjustment plate 52 are positioned closer to the upper surface 70 of the adjustment plate 52 than to the lower surface 72. As such, the adjustment plate 52 may be reoriented to secure it to the keeper 62 with the lower surface 72 facing upwardly and the upper surface 70 facing downwardly. In this case, the (now downwardly facing) upper surface 70 of the adjustment plate 52 would provide an alternative batten bar contacting surface, rather than the alternative batten bar contacting surface being provided by the (now upwardly facing) lower surface 72. By so reorienting the adjustment plate 52 before securing it to the keeper 62, the adjustment plate 52 is able to provide an alternative batten bar contacting surface in four more positions or elevations. More particularly, fasteners 64 may be received by the upper apertures 56*a* and 56*b* of the keeper 62 and by the upper apertures 76*a* and 76*b* of the adjustment plate 52 (with the upper surface 70 of the adjustment plate 52 facing downwardly) to provide an alternative batten bar contacting surface in a fifth position. Fasteners 64 could be received by the upper apertures 56*a* and 56*b* of the keeper 62 and by the lower apertures 76*c* and 76*d* of the adjustment plate 52 (with the upper surface 70 of the adjustment plate 52 facing downwardly) to provide an alternative batten bar contacting surface in a sixth position. Fasteners 64 could be received by the lower apertures 56*c* and 56*d* of the keeper 62 and by the upper apertures 76*a* and 76*b* of the adjustment plate 52 (with the upper surface 70 of the adjustment plate 52 facing downwardly) to provide an alternative batten bar contacting surface in a seventh position. Finally, fasteners 64 could be received by the lower apertures 56*c* and 56*d* of the keeper 62 and by the lower apertures 76*c* and 76*d* of the adjustment plate 52 (with the upper surface 70 of the adjustment plate 52 facing downwardly) to provide an alternative batten bar contacting surface in an eighth position.

In one exemplary embodiment, the eight possible positions of the alternative batten bar contacting surface allow for adjustment in 0.125" increments from a minimum adjustment of 0.125" to a maximum adjustment of 1.000". In other embodiments, different increments may be employed, which may include uniform increments between each successive position or different increments between at least two pairs of successive positions. It is also within the scope of the present disclosure for an alternative batten bar contacting surface to provide for a maximum adjustment that is greater than 1.000" and/or a minimum adjustment that is smaller than 0.125", which may include no adjustment or an adjustment of zero inches, if one of the positions places the alternative batten at the same or a higher elevation than the batten bar contacting surface (as described above). On account of the several different ways in which the adjustment plate 52 may be secured to the keeper 62, it may be advantageous to provide the adjustment plate 52 and/or the downwardly extending portion 58 of the arm 60 of the keeper 62 with markings or a label to uniquely identify the different apertures or otherwise provide some indication of the degree of adjustment that can be expected when using a particular aperture to secure the adjustment plate 52 to the keeper 62. If the adjustment plate 52 includes markings or a label, it may be advantageous for the front surface 78 and the rear surface 80 of the adjustment plate 52 to each include markings or a label for improved clarity of the markings. In that case, when the adjustment plate 52 is inverted (to cause the upper surface 70 to face downwardly), the orientations of the front and rear surfaces 78 and 80 may also be reversed (with the front surface 78 facing the keeper 62, rather than the rear surface 80 facing the keeper 62) to expose the markings or label on the rear surface 80 for indicating the proper apertures to be employed to achieve a particular position or elevation for the alternative batten bar contacting surface.

Figure 6:
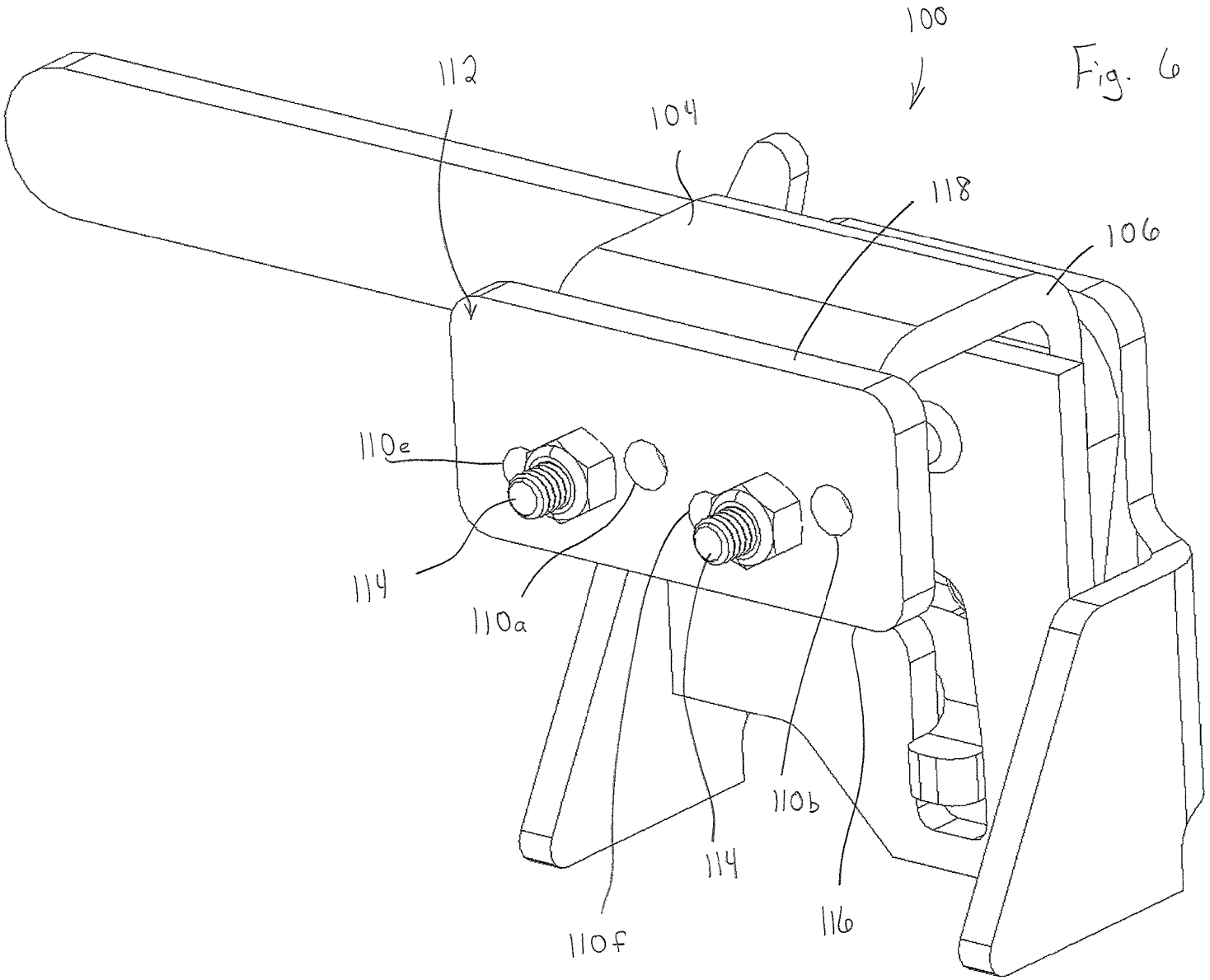
FIG. 6 is a perspective view of another exemplary hatch cover lock according to an aspect of the present disclosure.
Figure 7:
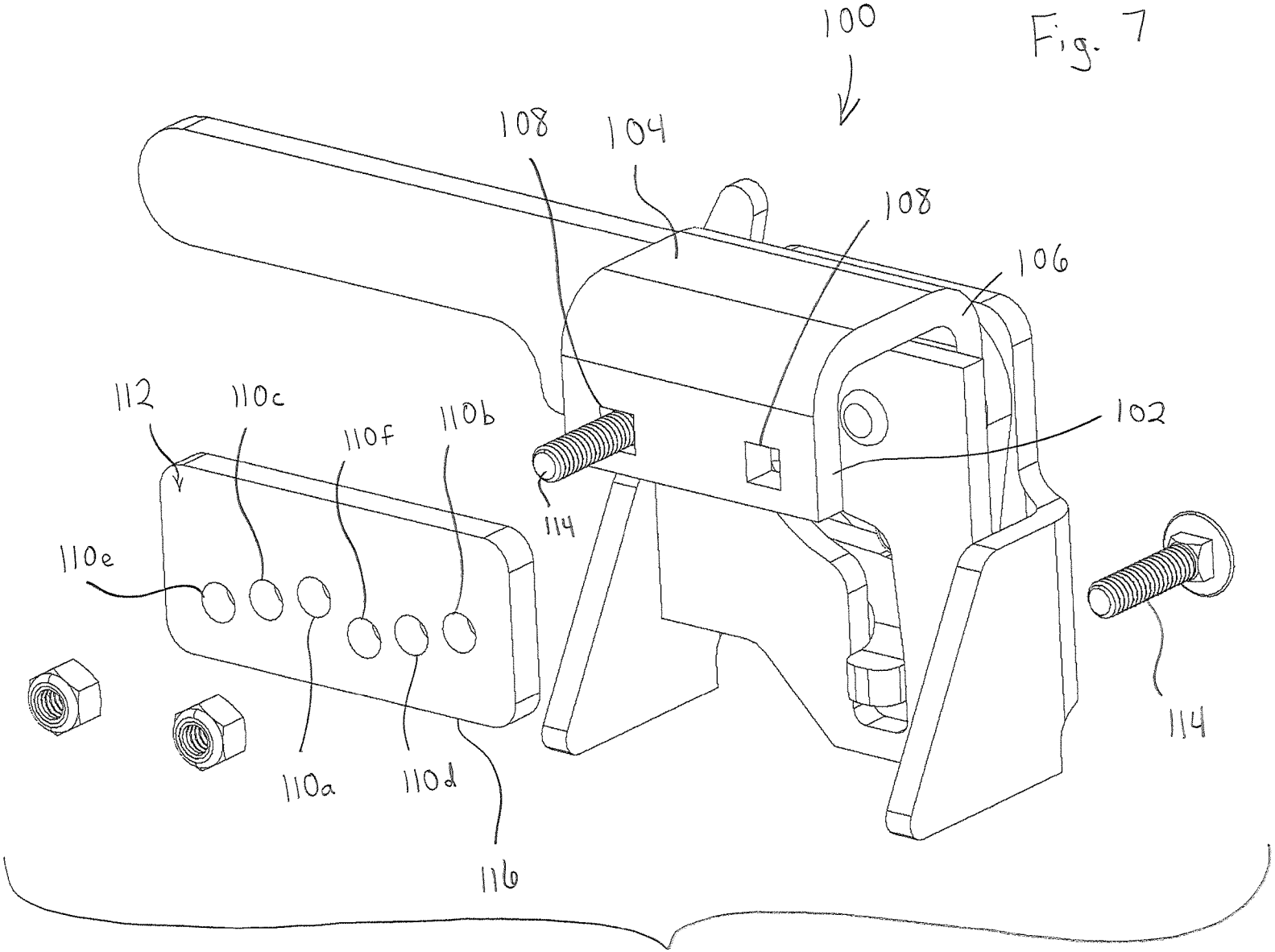
FIG. 7 is an exploded view of the hatch cover lock of FIG. 6.

It should be understood that a keeper and adjustment plate may be provided with different numbers of apertures and/or differently positioned apertures to provide a different assortment of possible elevations of an alternative batten bar contacting surface. For example, FIGS. 6 and 7 illustrate a variation of the adjustable hatch cover lock 50 of FIGS. 4 and 5. In the adjustable hatch cover lock 100 of FIGS. 6 and 7, the downwardly extending portion 102 of the arm 104 of the keeper 106 includes only one row of apertures 108, while three rows of apertures 110 are defined in the adjustment plate 112. As in the embodiment of FIGS. 4 and 5, the illustrated rows of apertures 110 of the adjustment plate 112 are laterally offset from each other, though it is within the scope of the present disclosure for the rows to be vertically aligned.

The adjustable hatch cover lock 100 of FIGS. 6 and 7 may be used similarly to the adjustable hatch cover lock 50 of FIGS. 4 and 5 to allow for an alternative batten bar contacting surface to be placed into six different positions or at six different elevations. More particularly, fasteners 114 may be received by the apertures 108 of the keeper 106 and the upper apertures 110*a* and 110*b* of the adjustment plate 112 (with the lower surface 116 of the adjustment plate 112 facing downwardly) to place the alternative batten bar contacting surface in a first position. Fasteners 114 may be received by the apertures 108 of the keeper 106 and the middle apertures 110*c* and 110*d* of the adjustment plate 112 (with the lower surface 116 of the adjustment plate 112 facing downwardly) to place the alternative batten bar contacting surface in a second position. Fasteners 114 may be received by the apertures 108 of the keeper 106 and the lower apertures 110*e* and 110*f* of the adjustment plate 112 (with the lower surface 116 of the adjustment plate 112 facing downwardly) to place the alternative batten bar contacting surface in a third position.

Similar to the embodiment of FIGS. 4 and 5, the apertures 110 of the adjustment plate 112 are placed closer to one of the lower and upper surfaces 116 and 118 than to the opposing surface. Accordingly, the adjustment plate 112 may be reoriented with the upper surface 118 facing downwardly before securing the adjustment plate 112 to the keeper 106 to provide another array of possible positions for an alternative batten bar contacting surface (defined by the downwardly facing upper surface 118). More particularly, fasteners 114 may be received by the apertures 108 of the keeper 106 and the upper apertures 110*a* and 110*b* of the adjustment plate 112 (with the upper surface 118 of the adjustment plate 112 facing downwardly) to place the alternative batten bar contacting surface in a fourth position. Fasteners 114 may be received by the apertures 108 of the keeper 106 and the middle apertures 110*c* and 110*d* of the adjustment plate 112 (with the upper surface 118 of the adjustment plate 112 facing downwardly) to place the alternative batten bar contacting surface in a fifth position. Fasteners 114 may be received by the apertures 108 of the keeper 106 and the lower apertures 110*e* and 110*f* of the adjustment plate 112 (with the upper surface 118 of the adjustment plate 112 facing downwardly) to place the alternative batten bar contacting surface in a sixth position.

It will be appreciated that the number of rows of apertures defined in the adjustment plate 112 and in the downwardly extending portion 102 of the arm 104 of the keeper 106 may be varied to change the number of possible positions for an alternative batten bar contacting surface. For example, the downwardly extending portion 102 of the arm 104 of the keeper 106 could be provided with a second row of apertures 108 to increase the total number of possible positions to twelve, or with a third row of apertures 108 to increase the total number of possible positions to eighteen. Of course, any number of rows of apertures could be provided, though it may be advantageous to limit the number of rows of apertures to avoid unnecessarily weakening the adjustment plate and/or the downwardly extending portion of the arm of the keeper.

Figure 8:
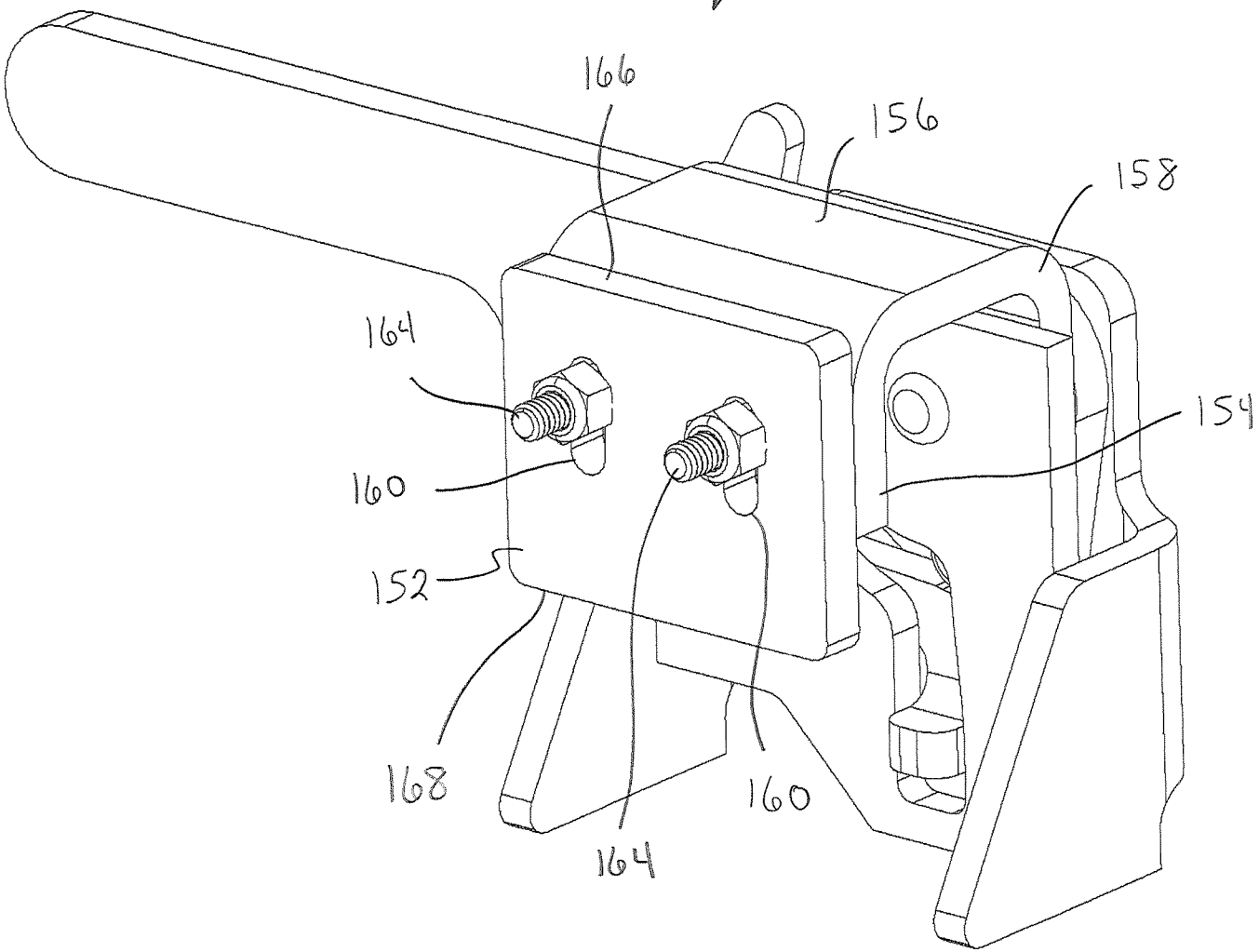
FIG. 8 is a perspective view of yet another exemplary hatch cover lock according to an aspect of the present disclosure.
Figure 9:
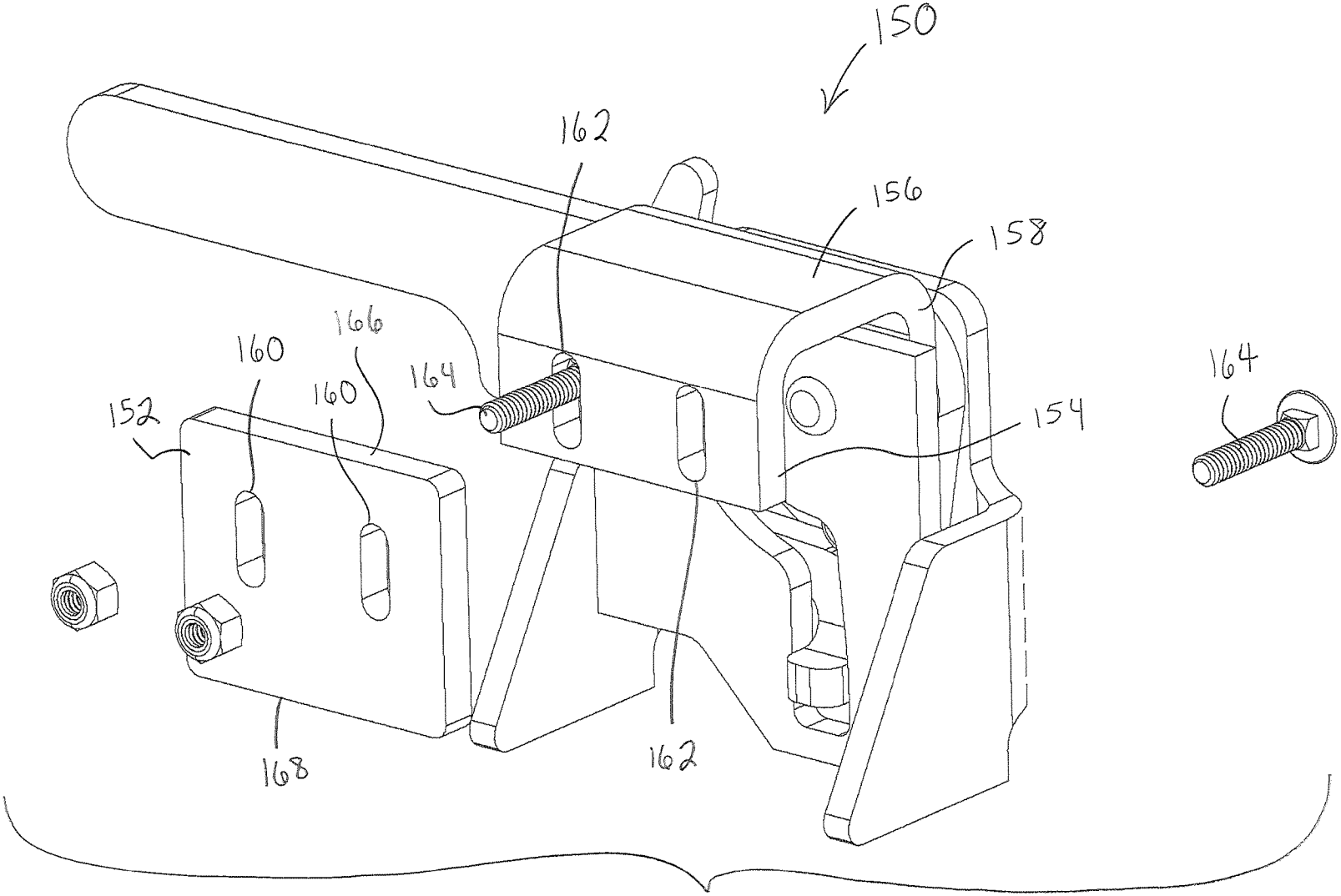
FIG. 9 is an exploded view of the hatch cover lock of FIG. 8.

The adjustable hatch cover locks 50 and 100 of FIGS. 4-7 allow for a plurality of discrete positions or elevations for the alternative batten bar contacting surface. However, it is within the scope of the present disclosure for an adjustable hatch cover lock to allow for infinite adjustment of the position of an alternative batten bar contacting surface between two extreme positions, as in the embodiment of FIGS. 8 and 9. In the adjustable hatch cover lock 150 of FIGS. 8 and 9, each of the adjustment plate 152 and the downwardly extending portion 154 of the arm 156 of the keeper 158 includes at least one aperture 160, 162 (respectively) that is configured as an elongated, vertically oriented slot. It should be understood that, while FIGS. 8 and 9 show each of the adjustment plate 152 and the keeper 158 as including a pair of elongated slots, it is within the scope of the present disclosure for only one of the adjustment plate 152 and the keeper 158 to include an elongated slot (while the other includes an aperture of the type shown in FIGS. 4-7 and/or a projection configured to be received within the elongated slot) and/or for the adjustment plate 152 and/or the keeper 158 to include either a single elongated slot or more than two elongated slots.

By providing at least one elongated slot 160, 162, the adjustment plate 152 is not limited to being secured to the downwardly extending portion 154 of the arm 156 of the keeper 158 in a particular number of predefined positions (as in the embodiments of FIGS. 4-7), but may be secured in any position between two extreme positions. The extreme positions are defined by the upper and lower ends of the elongated slot, with the adjustment plate 152 being secured to the keeper 158 in an uppermost position when a fastener 164 or protrusion is positioned at the lower end of the elongated slot of the adjustment plate 152, and with the adjustment plate 152 being secured to the keeper 158 in a lowermost position when a fastener 164 or protrusion is positioned at the upper end of the elongated slot of the adjustment plate 152. If each of the adjustment plate 152 and the keeper 158 includes an elongated slot, the adjustment plate 152 will be in its uppermost position when the fastener 164 or protrusion is positioned at the lower end of the elongated slot of the adjustment plate 152 and the upper end of the corresponding slot of the keeper 158, while being in its lowermost position when the fastener 164 or protrusion is positioned at the upper end of the elongated slot of the adjustment plate 152 and the lower end of the corresponding slot of the keeper 158. The vertical position of the adjustment plate 152 is infinitely adjustable between the uppermost and lowermost positions, with the adjustment plate 152 being moved into the target position and then secured to the keeper 158, thereby allowing for more fine-tuning of the position of the alternative batten bar contacting surface than is possible when only discrete positions are available. However, the embodiment of FIGS. 8 and 9 relies on the preload in the fasteners 164 to ensure that the alternative batten bar contacting surface remains in the desired position or at the desired elevation, so extra care must be taken to ensure that the fasteners 164 are especially secured to prevent loosening, which would compromise the position of the alternative batten bar contacting surface.

Similar to the embodiments of FIGS. 4-7, the elongated slots 160 of the adjustment plate 152 are positioned closer to one of the upper and lower surfaces 166 of the adjustment plate 168 than to the opposing surface. Thus, as described above with respect to the embodiments of FIGS. 4-7, the adjustment plate 152 may either be secured to the keeper 158 with the lower surface 168 facing downwardly (such that the lower surface 168 provides an alternative batten bar contacting surface) or with the upper surface 166 facing downwardly (such that the downwardly facing upper surface 166 provides an alternative batten bar contacting surface) to provide a second range of possible positions or elevations for the alternative batten bar contacting surface.

Figure 10:
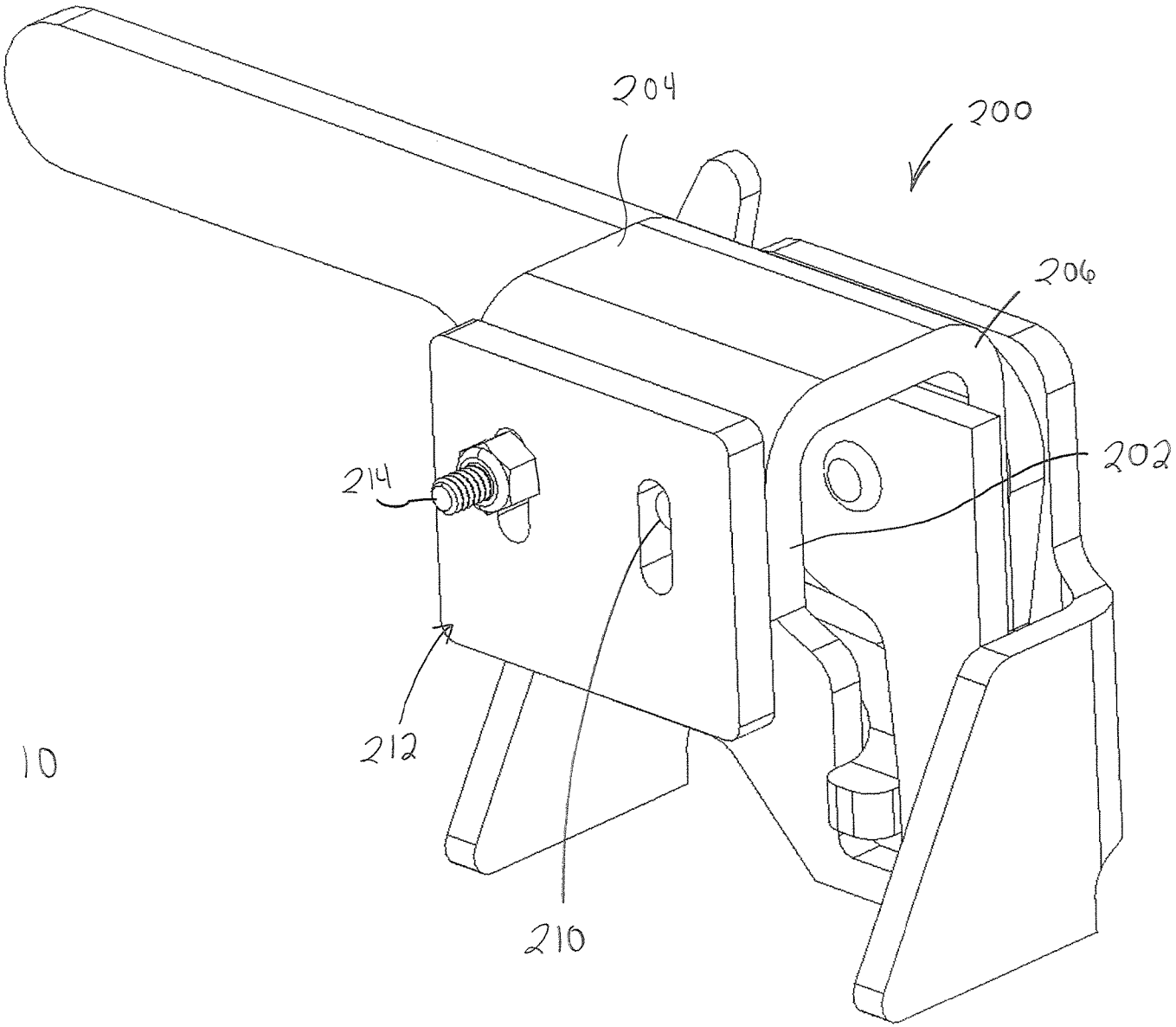
FIG. 10 is a perspective view of another exemplary hatch cover lock according to an aspect of the present disclosure.
Figure 11:
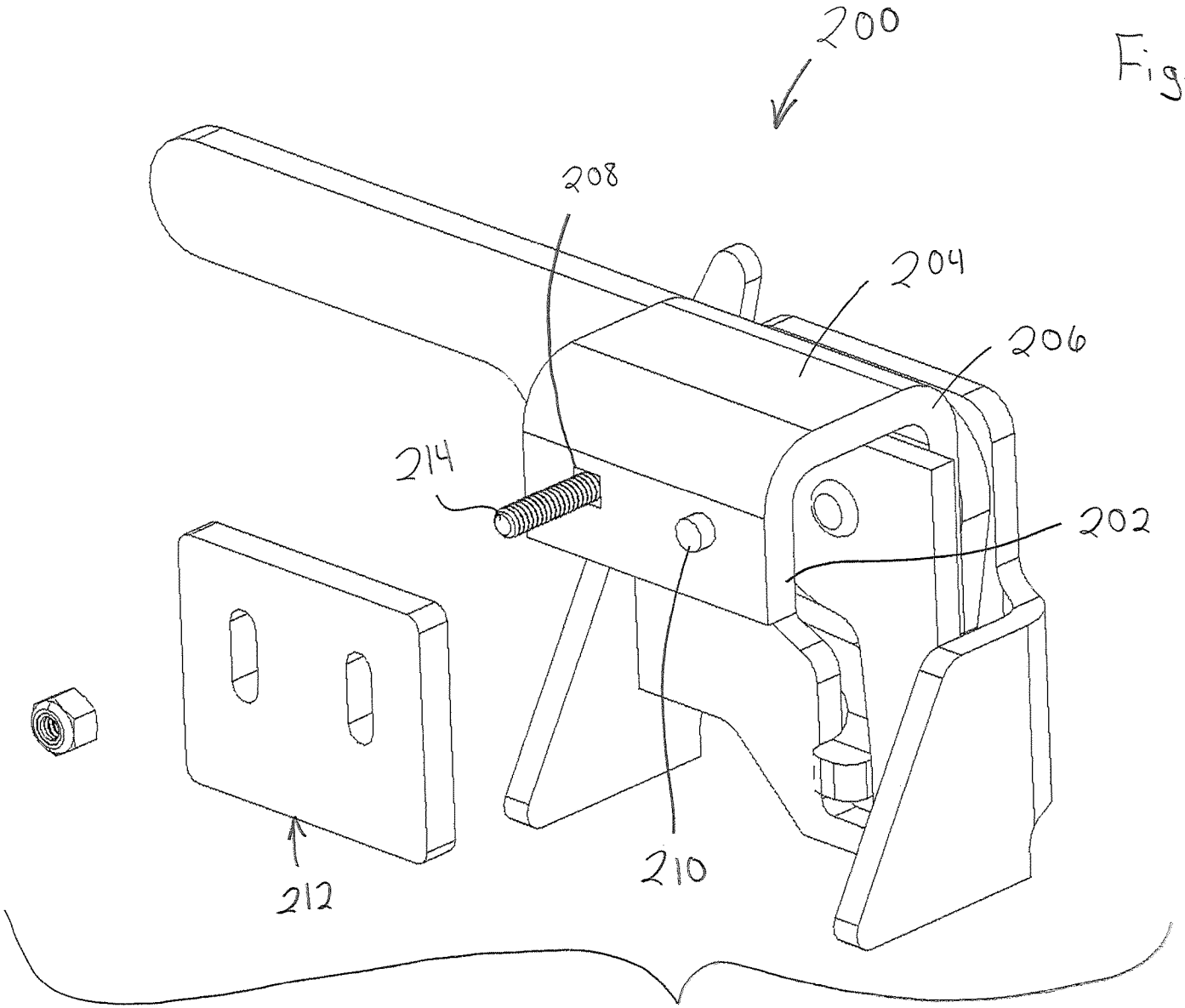
FIG. 11 is an exploded view of the hatch cover lock of FIG. 10.

As described above, it is within the scope of the present disclosure for one or both of the keeper and the adjustment plate to include a protrusion configured to be received by an aperture of the other component. FIGS. 10 and 11 show such an adjustable hatch cover lock 200, with the downwardly extending portion 202 of the arm 204 of the keeper 206 including one aperture 208 and one protrusion 210 positioned at the same height as the aperture 208. The protrusion 210 may be formed when the keeper 206 is formed (e.g., by a stamping process that provides the keeper 206 with an integrally formed protrusion 210) or may be separately provided (e.g., by welding the protrusion 210 to a conventionally configured keeper when the use of an adjustment plate 212 becomes necessary). Additionally, while FIGS. 10 and 11 show a protrusion 210 associated with the keeper 206, it is within the scope of the present disclosure for a protrusion to instead be associated with the adjustment plate 212.

In the embodiment of FIGS. 10 and 11, the adjustment plate 212 has a pair of apertures 210 configured as elongated slots, such that the protrusion 210 is received by one of the elongated slots, while a fastener 214 (illustrated as a nut and bolt, but subject to being differently configured) is received by the other elongated slot and by an aperture 208 defined in the downwardly extending portion 202 of the arm 204 of the keeper 206 (FIG. 11) to secure the adjustment plate 212 to the keeper 206. The protrusion 210 is intended to provide an orientation function (i.e., to properly position the adjustment plate 212 with respect to the keeper 206), rather than being used to secure the adjustment plate 212 to the keeper 206. However, it is contemplated that the protrusion 210 could contribute to securing the adjustment plate 212 to the keeper 260, such as by forming a friction fit within an aperture or slot or by being otherwise secured to the other component (e.g., with a weld or a nut or the like).

Figure 12:
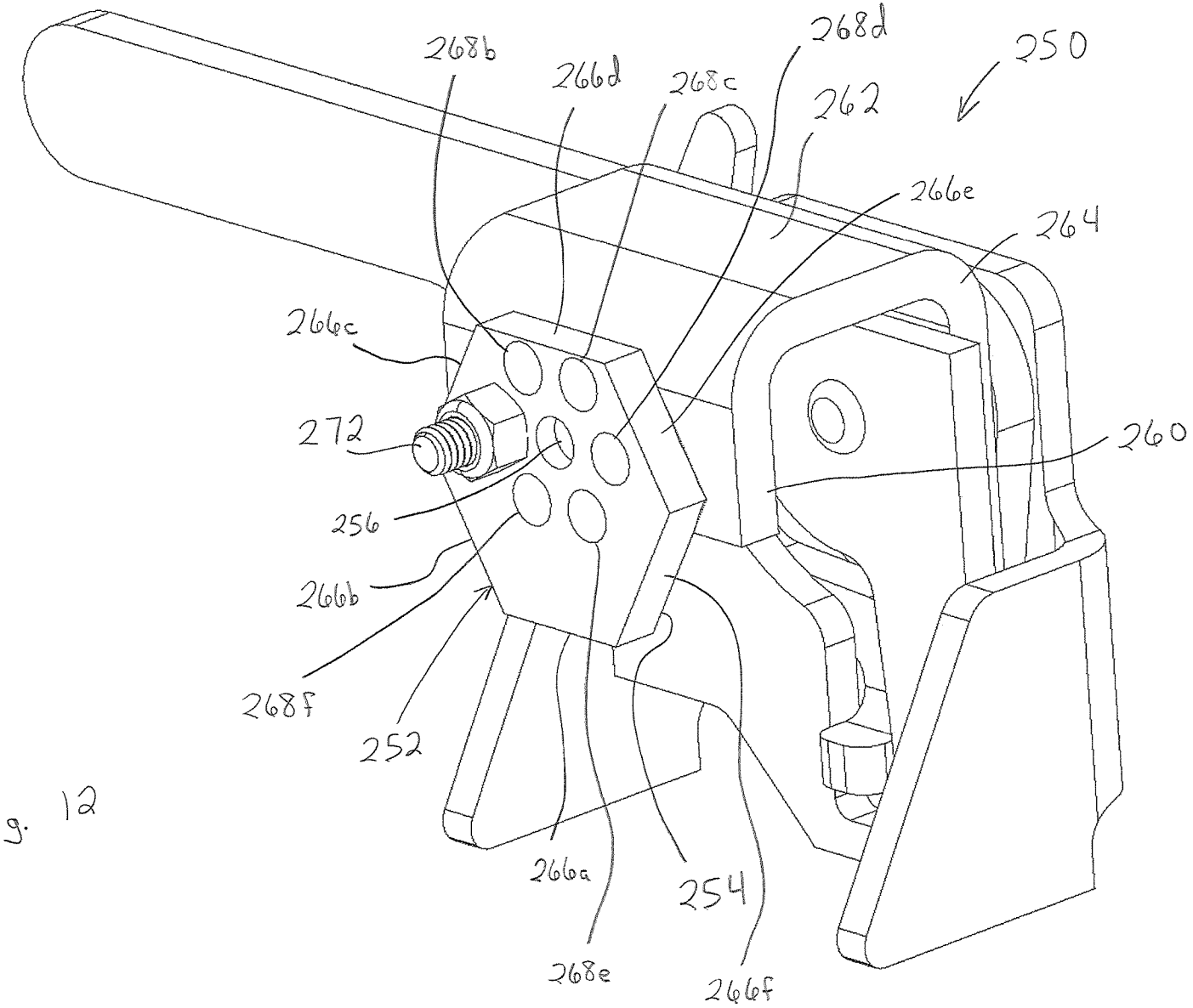
FIG. 12 is a perspective view of yet another exemplary hatch cover lock according to an aspect of the present disclosure.
Figure 13:
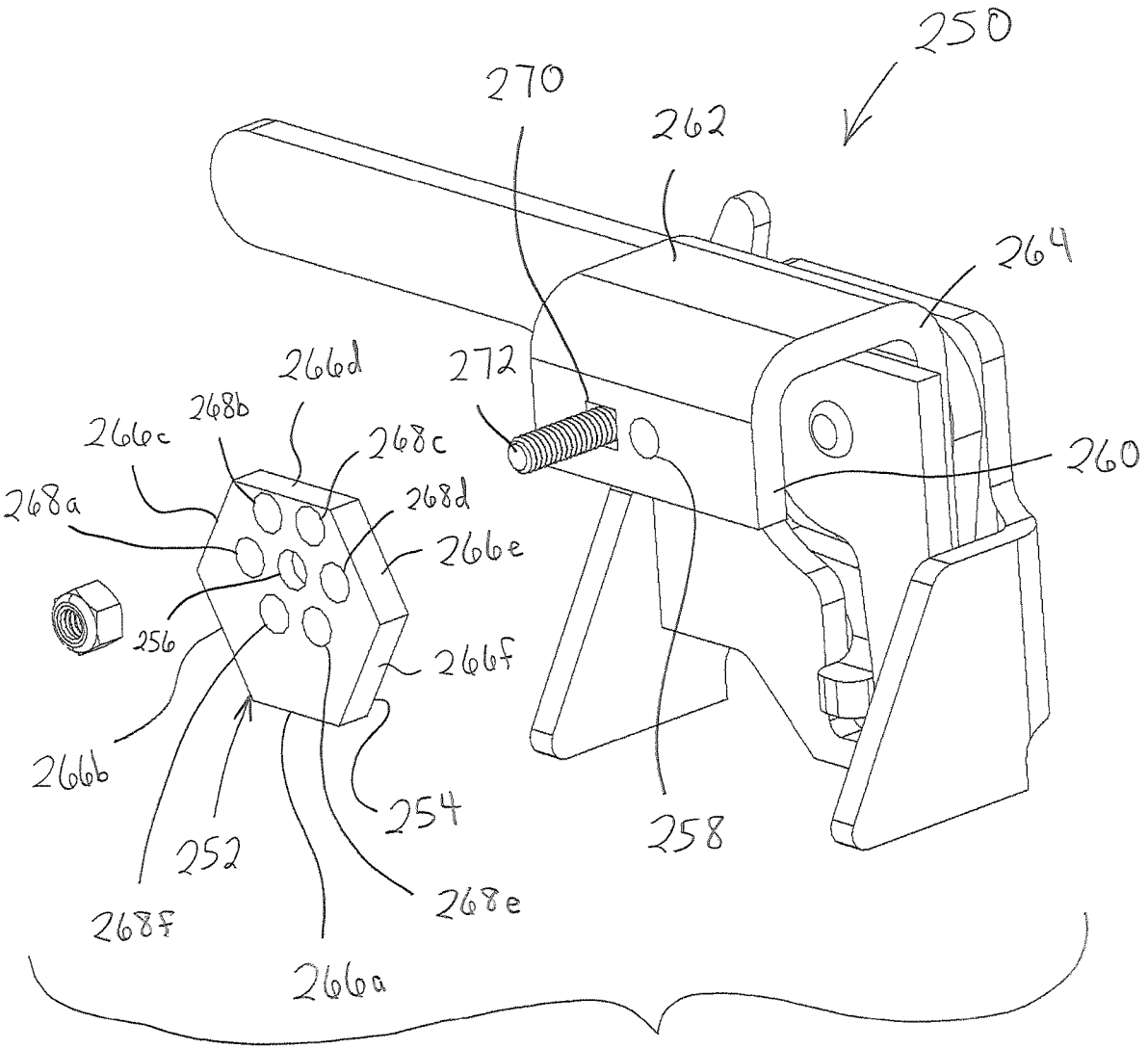
FIG. 13 is an exploded view of the hatch cover lock of FIG. 12.

FIGS. 12 and 13 illustrate another embodiment of an adjustable hatch cover lock 250 employing a protrusion. In particular, the adjustable hatch cover lock 250 of FIGS. 12 and 13 includes an adjustment plate 252 having a rear surface 254 with a protrusion 256 (FIG. 14) configured to be received by an aperture 258 defined in the downwardly extending portion 260 of the arm 262 of an associated keeper 264. While the illustrated embodiment employs an adjustment plate 252 having a protrusion 256 received by an aperture 258 of the keeper 264, it is within the scope of the present disclosure for the protrusion to be incorporated into the keeper 264, with such a protrusion being received by an aperture defined in the adjustment plate 252.

The adjustment plate 252 is differently configured from the adjustment plates of FIGS. 4-11, which are generally rectangular. In the embodiment of FIGS. 12 and 13, the adjustment plate 252 is substantially hexagonal, with an outer perimeter defined by six edges or regions 266*a*-266*f*. The protrusion 256 is surrounded by or centrally located with respect to six apertures 268*a*-268*f*, with each aperture 268 corresponding to one of the regions 266 of the outer perimeter. In use, the protrusion 256 is placed into the associated aperture 258 of the keeper 264, followed by the adjustment plate 252 being rotated about the protrusion 256 (which acts as an axis of rotation) to orient one of the edges 266 of the adjustment plate 252 to face downwardly, thereby providing an alternative batten bar contacting surface. So positioning one of the edges 266 will orient the associated aperture 268 with an aperture 270 of the keeper 264, with a fastener 272 being placed into the aligned apertures 268 and 272 to secure the adjustment plate 252 to the keeper 264. It will be seen that the protrusion 256 is spaced away from the center of the adjustment plate 252, such that each edge 266 is spaced a different distance from the axis of rotation. Accordingly, each edge 266, when oriented to face downwardly, will provide an alternative batten bar contacting surface at a different position or elevation, which gives the adjustment plate 252 the flexibility to provide different degrees of adjustment.

Figure 14:
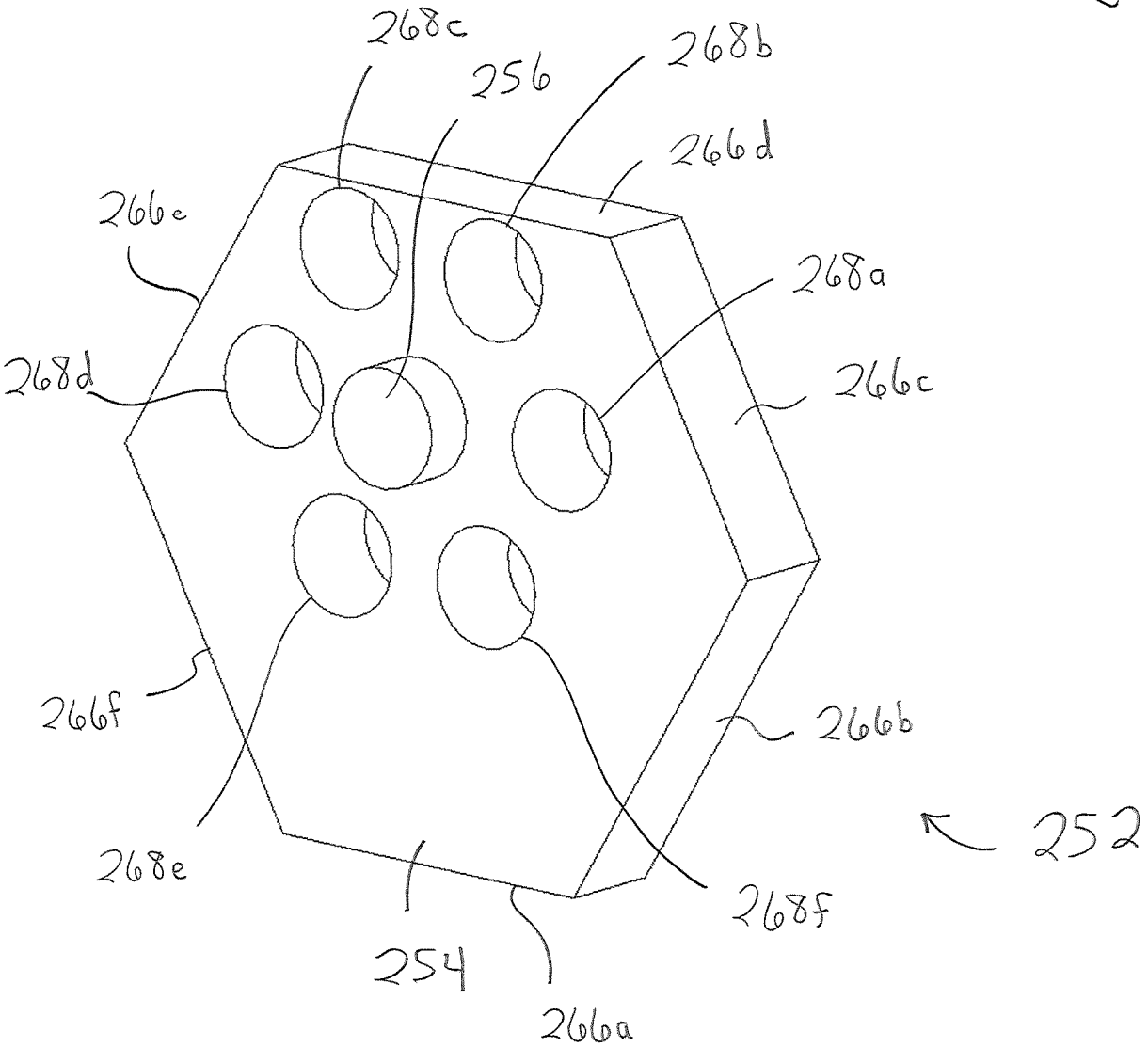
FIG. 14 is a perspective view of an adjustment plate of the hatch cover lock of FIGS. 12 and 13.

While FIGS. 12-14 illustrate the adjustment plate 252 as being substantially hexagonal, the outer perimeter could be provided with a different shape without departing from the scope of the present disclosure. For example, the adjustment plate could be substantially circular or oblong and still provide the above-described cam function. If provided as a circle, the axis of rotation would be spaced away from the center of the adjustment plate (as in the illustrated embodiment), such that rotation of the adjustment plate about the axis of rotation would downwardly orient different regions of the outer perimeter of the adjustment plate. Due to the axis of rotation being spaced away from the center of the adjustment plate, the different regions of the outer perimeter of the adjustment plate (when facing downwardly) would provide alternative batten bar contacting surfaces having different elevations. A similar approach could be taken for an outer perimeter having any other basic or uniform shape (e.g., a square or equilateral triangle or pentagon). In the case of an oblong shape or other non-uniform shape (e.g., a non-equilateral triangle or some other irregular shape), the axis of rotation could be either centrally located or spaced from a center of the adjustment plate to provide different positions or elevations for an alternative batten bar contacting surface upon rotation of the adjustment plate about the axis of rotation.

Figure 15:
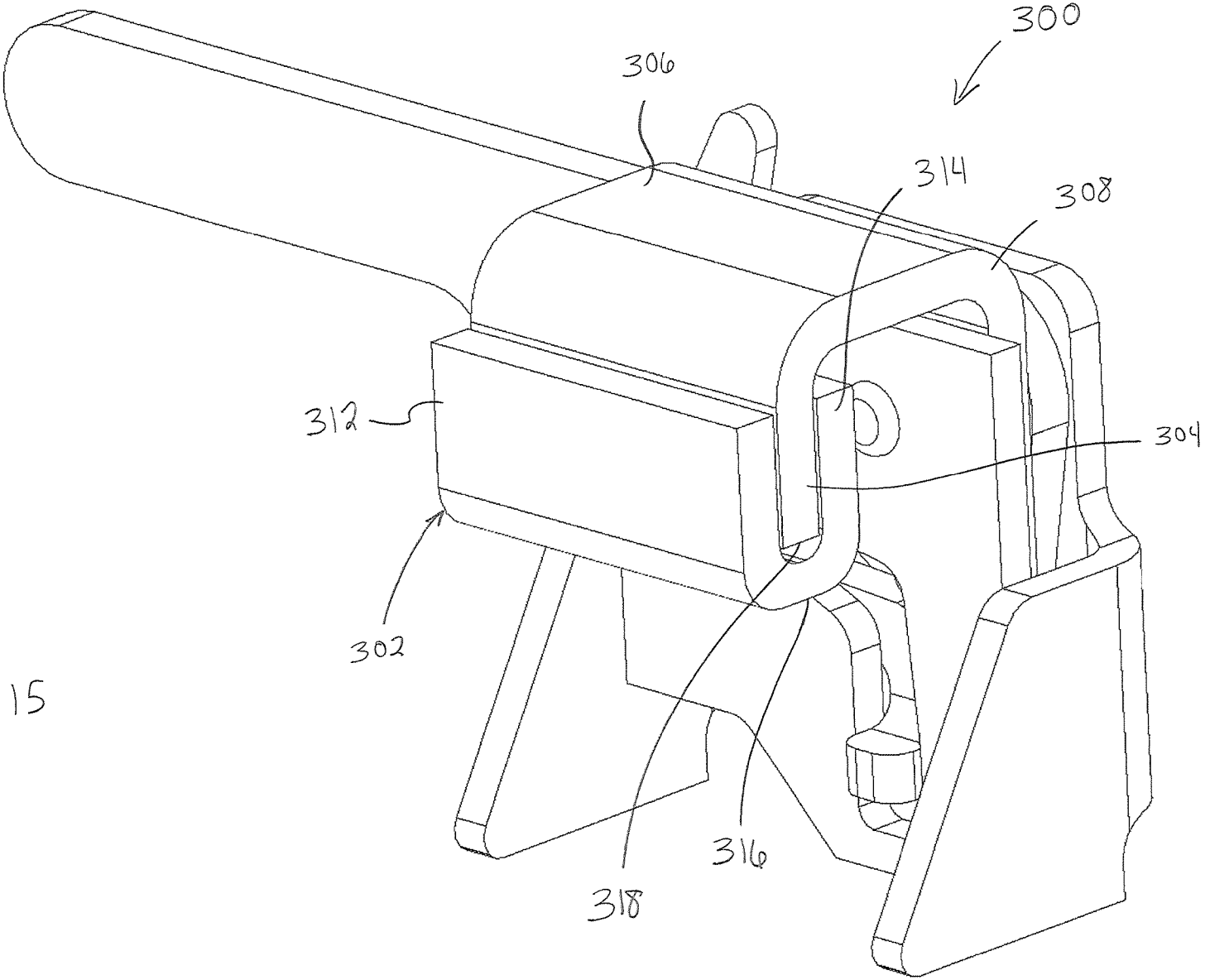
FIG. 15 is a perspective view of another exemplary hatch cover lock according to an aspect of the present disclosure.
Figure 16:
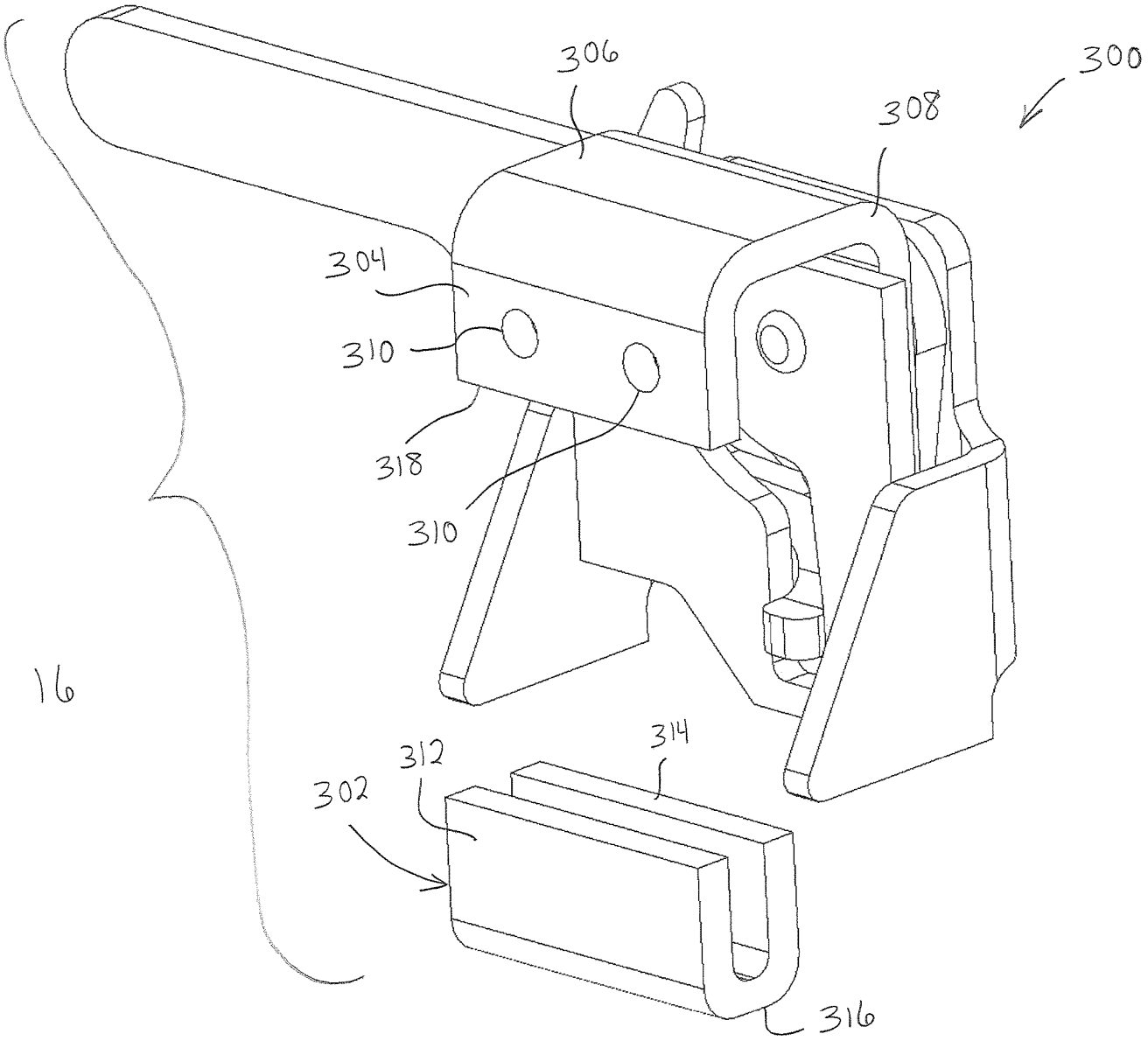
FIG. 16 is an exploded view of the hatch cover lock of FIG. 15.
Figure 17:
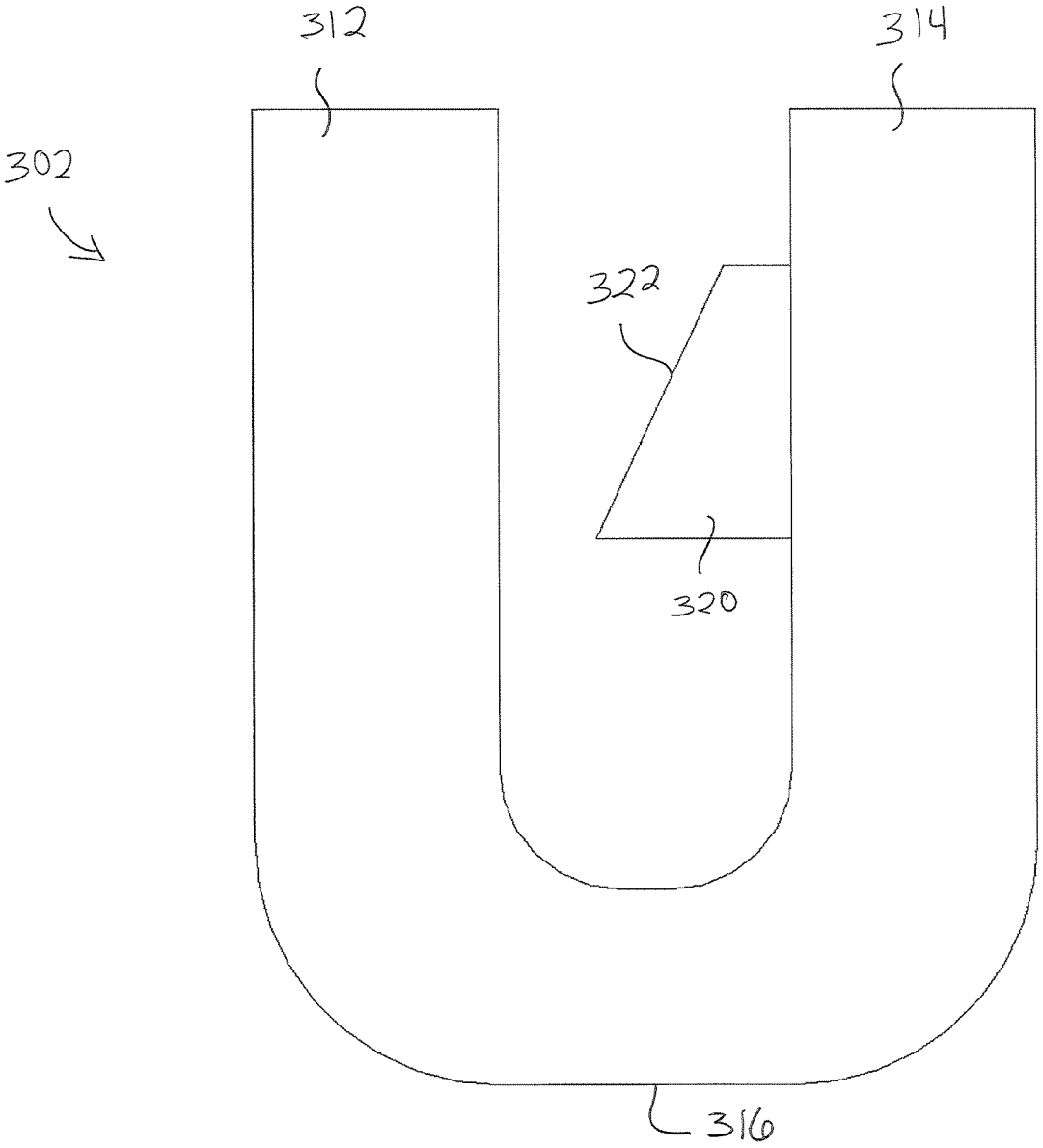
FIG. 17 is a side elevational view of an extension piece of the hatch cover lock of FIGS. 15 and 16.

FIGS. 4-14 illustrate adjustable hatch cover locks having variously configured adjustment plates. Rather than an adjustment plate, an adjustable hatch cover lock may instead be provided with an extension piece that provides an alternative batten bar contacting surface. For example, FIGS. 15 and 16 illustrate an exemplary embodiment of an adjustable hatch cover lock 300 including an extension piece 302, which is shown in greater detail in FIG. 17. In the illustrated embodiment, the downwardly extending portion 304 of the arm 306 of the keeper 308 is provided with at least one aperture 310, as in the previously described embodiments. The keeper 308 is shown in FIG. 16 with a pair of apertures 310, which may be advantageous for stabilizing the position of an extension piece 302 secured to the keeper 308, similar to the way in which pairs of apertures and fasteners or protrusions may be used to stabilize the position of an adjustment plate (as described above). However, it is within the scope of the present disclosure for a different number of apertures 310 to be defined in the downwardly extending portion 304 of the arm 306 of the keeper 308.

The extension piece 302 includes first and second legs 312 and 314, with an alternative batten bar contacting surface 316 extending therebetween. The extension piece 302 is configured such that all or a portion of the downwardly extending portion 304 of the arm 306 of the keeper 308 is received between the first and second legs 312 and 314, as shown in FIG. 15. With the extension piece 302 so associated to the keeper 308, the first leg 312 is positioned adjacent to a front surface of the downwardly extending portion 304 of the arm 306 of the keeper 308, the second leg 314 is positioned adjacent to a rear surface of the downwardly extending portion 304 of the arm 306 of the keeper 308, and the alternative batten bar contacting surface 316 is positioned adjacent to the batten bar contacting surface 318. It will be seen that the alternative batten bar contacting surface 316 is positioned below the batten bar contacting surface 318 in the orientation of FIG. 15, which allows for the alternative batten bar contacting surface 316 to be used in combination with a batten bar or hatch cover tab having a gasket that has become worn out.

At least one of the legs 312, 314 of the extension piece 302 may be provided with at least one protrusion 320 (shown in FIG. 17 as a protrusion 320 associated with the second leg 314) that is received by an associated aperture 310 of the keeper 308. If multiple apertures 310 are provided (as in the illustrated embodiment), an equal number of protrusions 320 may be provided, with each protrusion 320 being received by a different aperture 310 to stabilize and secure the extension piece 302 to the keeper 308. At least one of the legs 312, 314 may be configured to flex away from the other leg 312, 314 to allow the protrusion 320 to be moved away from the batten bar contacting surface 318 and passed upwardly and into the associated aperture 310. The protrusion 320 may be provided with an angled surface 322 (FIG. 17) configured to contact the batten bar contacting surface 318 and facilitate flexure of the legs 312 and 314 away from each other as the extension piece 302 is pressed onto the downwardly extending portion 304 of the arm 306 of the keeper 308. As the protrusion 320 moves into alignment with the associated aperture 310, the legs 312 and 314 will flex back toward each other (e.g., back to their original configuration) to effectively clip the extension piece 302 onto the keeper 308, in the configuration of FIG. 15.

It will be seen that, with a single protrusion/aperture (or multiple protrusions/apertures provided at the same height, as in the illustrated embodiment), only a single alternative batten bar contacting surface elevation or position is possible. If a different elevation or position is required, the extension piece 302 could be replaced with a differently configured extension piece (particularly, one with a different distance between the protrusion and the alternative batten bar contacting surface or one with an alternative batten bar contacting surface having a greater thickness or vertical dimension). In yet another embodiment, the downwardly extending portion 304 of the arm 306 of the keeper 308 is provided with multiple rows of apertures 310 positioned at different heights, with the protrusion 320 being configured to be selectively received in an aperture 310 of one of the rows. Depending on the height of the row of the aperture 310 receiving the protrusion 320, the position or elevation of the alternative batten bar contacting surface 316 will vary, thereby allowing for a single extension piece 302 to provide different degrees of adjustment.

FIGS. 18-25 show different embodiments of systems for locking and unlocking a hatch cover according to another aspect of the present disclosure. The systems of FIGS. 18-25 employ mounting brackets to accommodate a hatch cover lock (e.g., one of the type described above and shown in FIGS. 1-3) in a plurality of different positions having different elevations, in order to compensate for the lower height of a batten bar or hatch cover tab having an associated gasket that has become worn out. The hatch cover locks shown in FIGS. 18-25 are similarly configured to the conventional hatch cover lock 10 of FIGS. 1-3, so the components of the hatch cover locks of FIGS. 18-25 that are configured according to conventional design will not be described in detail herein. Rather, only the differences between the conventional design and the illustrated hatch cover locks of FIGS. 18-25 will be explained.

It will be appreciated that, due to the hatch cover locks of the systems of FIGS. 18-25 being similarly configured to the conventional design, a conventional hatch cover lock may be paired with a mounting bracket according to the present disclosure when providing a new railcar, as systems of the type shown in FIGS. 18-25 and described herein may be used in combination with a batten bar or hatch cover tab having a new gasket or a worn gasket. The hatch cover lock may be secured to the associated mounting bracket in an initial position (for when the gasket of the associated batten bar or hatch cover tab is new), with the hatch cover lock being moved into a different position with respect to the associated mounting bracket later in time, if the gasket of the associated batten bar or hatch cover tab has become worn out.

Figure 18:
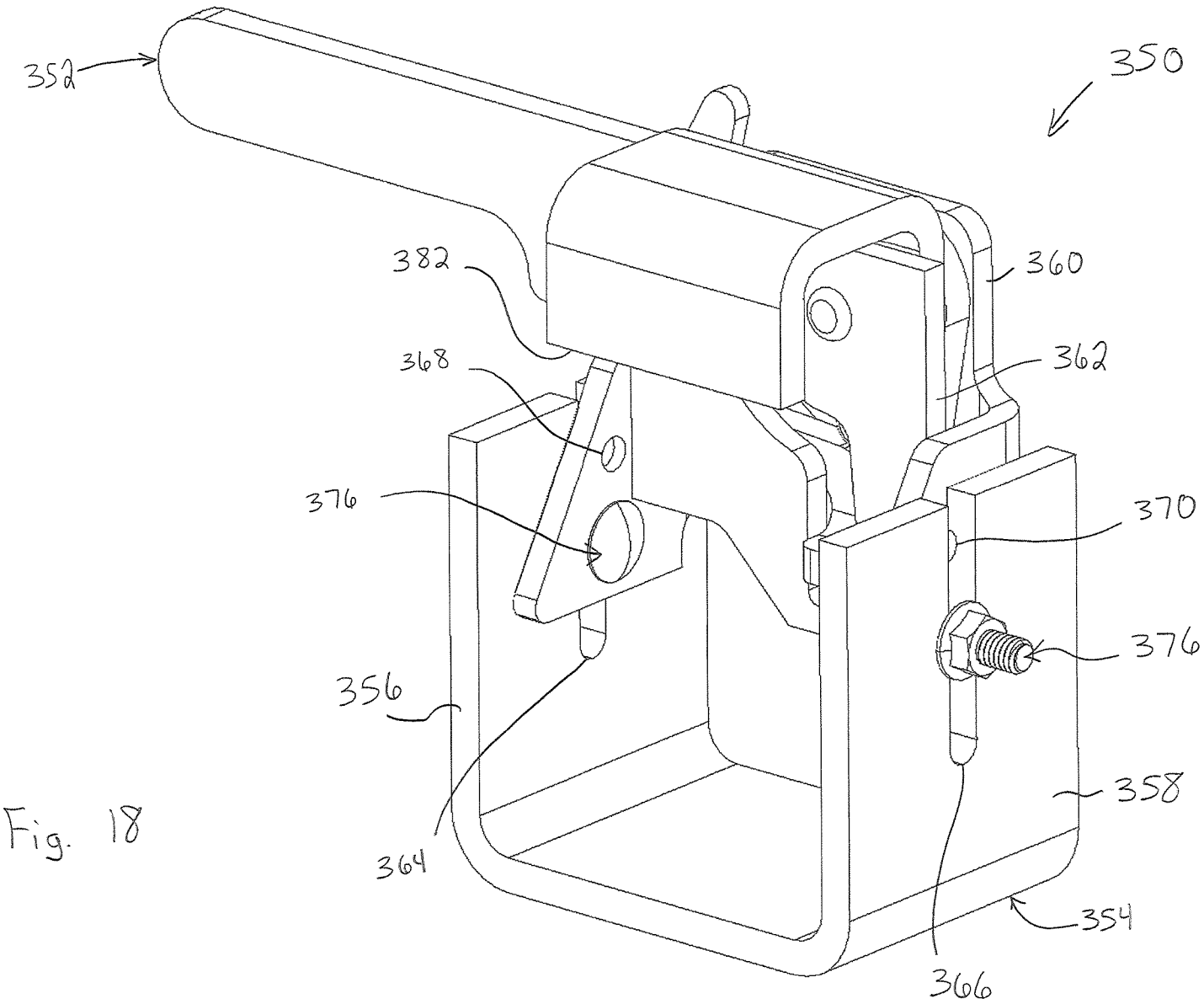
FIG. 18 is a perspective view of an exemplary system for locking and unlocking a hatch cover, according to an aspect of the present disclosure.
Figure 19:
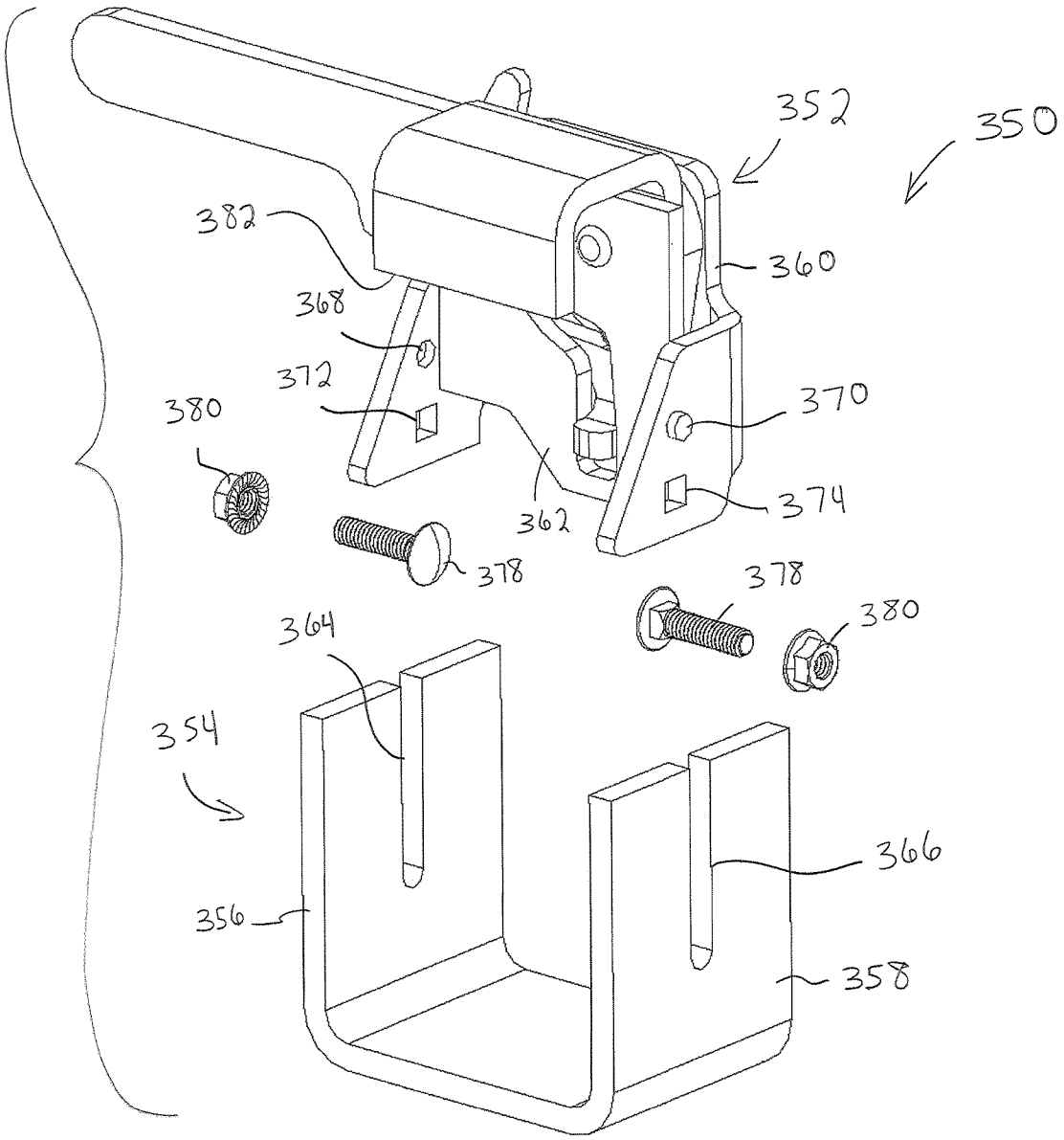
FIG. 19 is an exploded view of the system of FIG. 18.

Turning now to the individual systems, FIGS. 18 and 19 show a system 350 comprising a hatch cover lock 352 and an associated mounting bracket 354. The mounting bracket 354 is configured to be secured to the top of a covered hopper railcar, such as with a weld or mechanical fasteners or the like. The hatch cover lock 352 is secured to the mounting bracket 354. The illustrated mounting bracket 354 includes first and second legs or sidewalls 356 and 358 configured to receive the hatch cover lock 352 therebetween. While FIGS. 18 and 19 show a mounting bracket 354 configured for receipt of a hatch cover lock 352 between a pair of opposing legs 356 and 358, it should be understood that the mounting bracket 354 may be differently configured. For example, in another embodiment, the legs 356 and 358 may be positioned more closely together, with a portion of the hatch cover lock 352 positioned laterally outwardly of one of the legs 356, 358, which may include a first portion of the hatch cover lock 352 positioned laterally outwardly of the first leg 356 and a second portion of the hatch cover lock 352 positioned laterally outwardly of the second leg 358. In another embodiment, one of the legs may be positioned laterally of the hatch cover lock 352, while the other leg is positioned rearwardly of or behind the hatch cover lock 352 (i.e., adjacent to the outer flange 360 of the hatch cover lock 352) or inwardly or in front of the hatch cover lock 352 (i.e., adjacent to the inner flange 362 of the hatch cover lock 352), provided that the positions and/or configurations of the legs do not prevent proper operation of the hatch cover lock 352. In yet another embodiment, one leg or sidewall is positioned rearwardly of the hatch cover lock 352, with the other leg or sidewall positioned inwardly of the hatch cover lock 352.

Regardless of the particular positions of the legs or sidewalls 356 and 358 of the mounting bracket 354, a substantially vertically oriented channel 364 is defined in the first leg 356, with another substantially vertically oriented channel 366 defined in the second leg 358. A protrusion 368 of the hatch cover lock 352 (shown as extending from a side surface of the outer flange 360) is received by the channel 364 of the first leg 356, while a second protrusion 370 of the hatch cover lock 352 is received by the channel 366 of the second leg 358. An aperture 372 is substantially vertically aligned with (either above or below) the first protrusion 368, while a second aperture 374 is substantially vertically aligned with (either above or below) the second protrusion 370. The illustrated embodiment has protrusions 368 and 370 positioned at the same height and apertures 372 and 374 positioned at the same (lower) height, but it is within the scope of the present disclosure for the protrusions 368 and 370 to be positioned at different heights and/or for the apertures 372 and 374 to be positioned at different heights, which may include one protrusion 368, 370 and one aperture 372, 374 positioned at the same height and/or at least one protrusion 368, 370 and/or aperture 372, 374 positioned at a different height than the other protrusions 368 and 370 and/or apertures 372 and 374. However, it may be advantageous for the protrusions 368 and 370 and apertures 372 and 374 to be symmetrically positioned for enhanced stability and improved securement of the hatch cover lock 352 to the mounting bracket 354.

The first and second protrusions 368 and 370 are received by the channels 364 and 366 of the first and second legs 356 and 358 of the mounting bracket 354, respectively. The apertures 372 and 374 are aligned with the channels 364 and 366, with each channel/aperture pair receiving an associated fastener assembly 376 for securing the hatch cover lock 352 to the mounting bracket 354. In the illustrated embodiment, each fastener assembly 376 comprises the combination of a carriage bolt 378 and a nut 380, but it should be understood that the fastener assemblies 376 may be differently configured without departing from the scope of the present disclosure, which may include two fastener assemblies of a single system being differently configured. Additionally, while two fastener assemblies 376 are illustrated, it is within the scope of the present disclosure for only a single fastener assembly to be employed.

With one protrusion 368, 370 and one fastener assembly 376 received by at least one of (but more preferably both of) the channels 364 and 366, the hatch cover lock 352 is prevented from rotating with respect to the mounting bracket 354 (and, hence, with respect to the associated railcar and batten bar or hatch cover tab). However, while the hatch cover lock 352 cannot rotate with respect to the mounting bracket 354, the hatch cover lock 352 may be moved vertically with respect to the mounting bracket 354 prior to securing hatch cover lock 352 to the mounting bracket 354 with the fastener assemblies 376. By such a configuration, the hatch cover lock 352 may be secured to the mounting bracket 354 in an initial position, which places the batten bar contacting surface 382 at a particular position or elevation.

The hatch cover lock 352 remains in the initial position until it proves to provide an insufficient seal, due to the gasket of the associated batten bar or hatch cover tab becoming worn out. At that time, the fastener assemblies 376 may be loosened or otherwise disengaged to allow the position of the hatch cover lock 352 with respect to the mounting bracket 354 to be adjusted, by sliding the protrusions 368 and 370 of the hatch cover lock 352 to lower positions within the respective channels 364 and 366 of the mounting bracket 354. When the protrusions 368 and 370 have reached a suitable second location, the fastener assemblies 376 may be reapplied to secure the hatch cover lock 352 to the mounting bracket 354 in a second position or at a second elevation. In the second position, the batten bar contacting surface 382 will be at a lower position or elevation, which is more appropriate for use in combination with a batten bar or hatch cover tab having a worn gasket. It will be seen that, between two extreme positions or elevations (namely, a maximum elevation at which the protrusions 368 and 370 are positioned at the top of the respective channels 364 and 366 and a minimum elevation at which the apertures 372 and 374 are positioned at the bottom of the respective channels 364 and 366), the position of the hatch cover lock 352 with respect to the mounting bracket 354 (and, hence, the elevation of the batten bar contacting surface 382) is infinitely adjustable. Additional steps may also be taken if it is required to more securely fasten the hatch cover lock 352 to the mounting bracket 354, which may include welding the hatch cover lock 352 to the mounting bracket 354 to better ensure that the position of the hatch cover lock 352 (and, hence, the elevation of the batten bar contacting surface 382) will not change or shift during use of the system 350.

While FIGS. 18 and 19 show protrusions and apertures associated with the hatch cover lock and channels associated with the mounting bracket, it should be understood that protrusions and apertures may instead be incorporated into the mounting bracket, while the channels receiving the protrusions and fastener assemblies are defined in the hatch cover lock. It is also within the scope of the present disclosure for one leg or sidewall of the mounting bracket to include a channel (to receive a protrusion of the hatch cover lock and a fastener assembly), while the other leg or sidewall of the mounting bracket includes a protrusion and a fastener-receiving aperture configured to be aligned with and received by a channel defined in the hatch cover lock.

Figure 20:
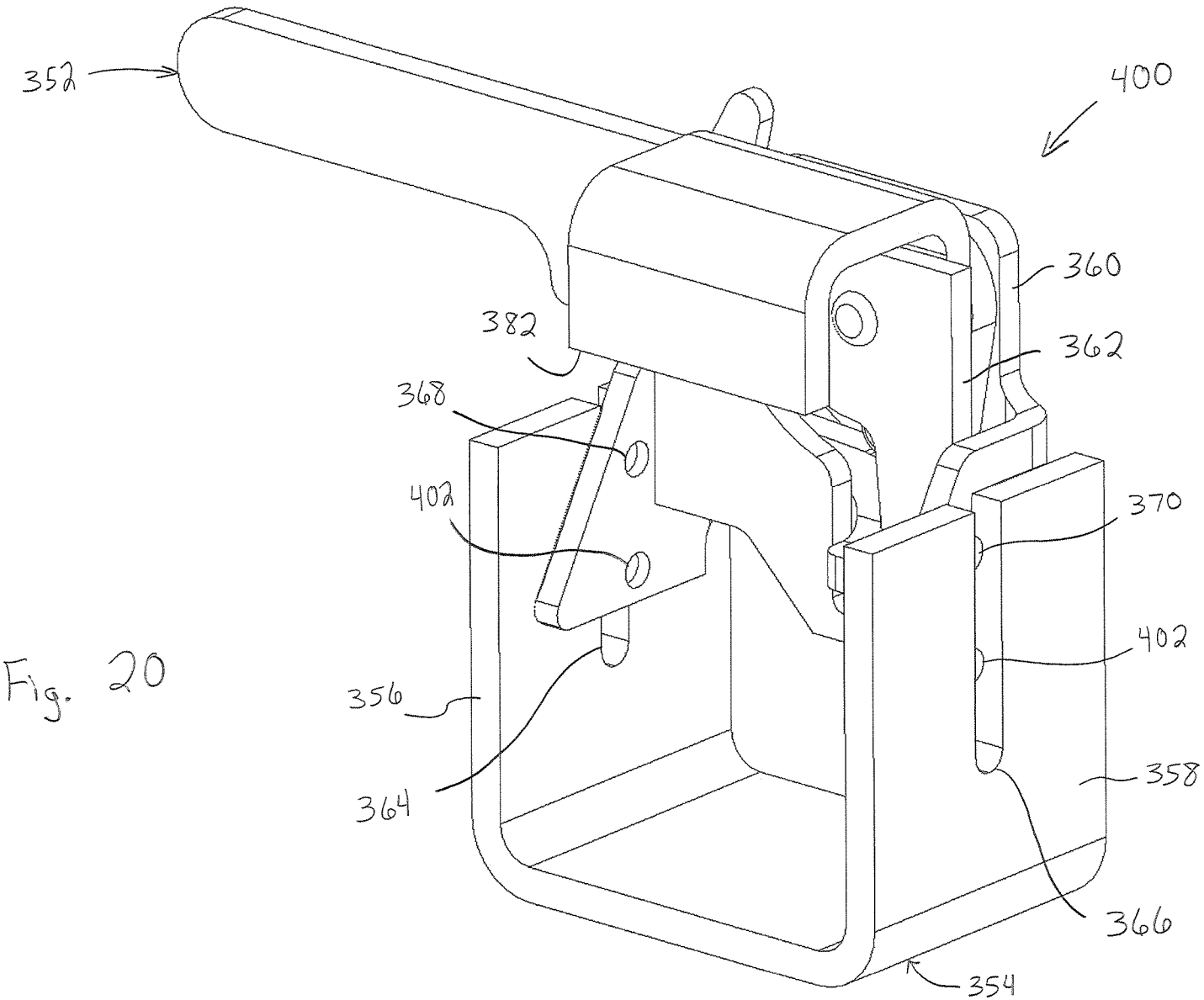
FIG. 20 is a perspective view of another exemplary system for locking and unlocking a hatch cover, according to an aspect of the present disclosure.
Figure 21:
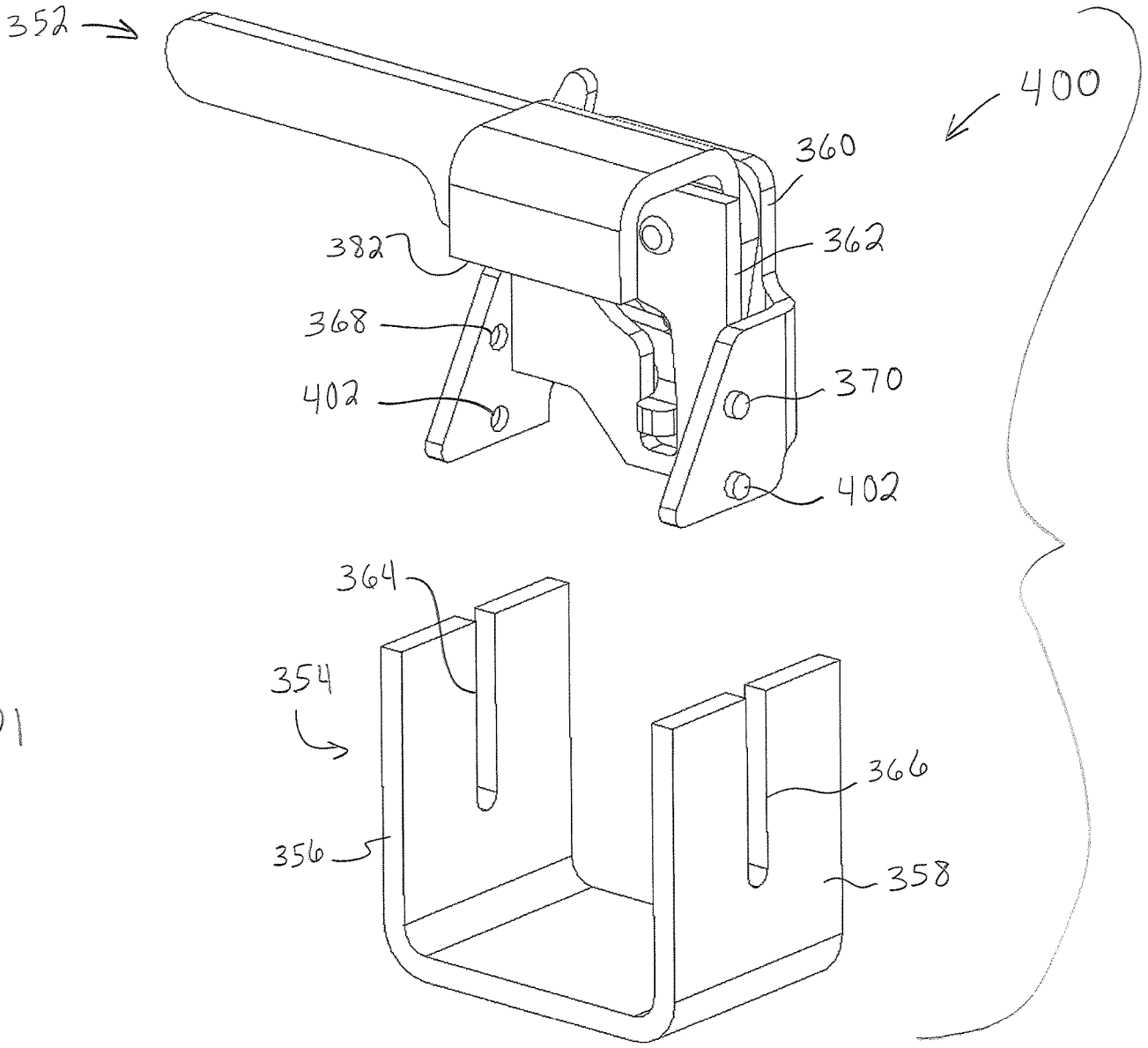
FIG. 21 is an exploded view of the system of FIG. 20.

Other possible modifications include replacing the fastener-receiving apertures with protrusions. For example, FIGS. 20 and 21 illustrate a system 400 that is similar to the system 350 of FIGS. 18 and 19 (with the common components being similarly labeled), except that the apertures 372 and 374 are replaced with protrusions 402. In the embodiment of FIGS. 20 and 21, each channel 364, 366 defined in the legs or sidewalls 356 and 358 of the mounting bracket 354 receives a pair of vertically aligned protrusions 368, 370 and 402, which allow for vertical adjustment of the position of the hatch cover lock 352 with respect to the mounting bracket 354 while preventing rotation of the hatch cover lock 352 with respect to the mounting bracket 354. As neither the hatch cover lock 352 nor the mounting bracket 354 is configured to accommodate a fastener assembly, the hatch cover lock 352 is instead welded or otherwise affixed to the mounting bracket 354 once the hatch cover lock 352 has been placed at the proper position or elevation.

Figure 22:
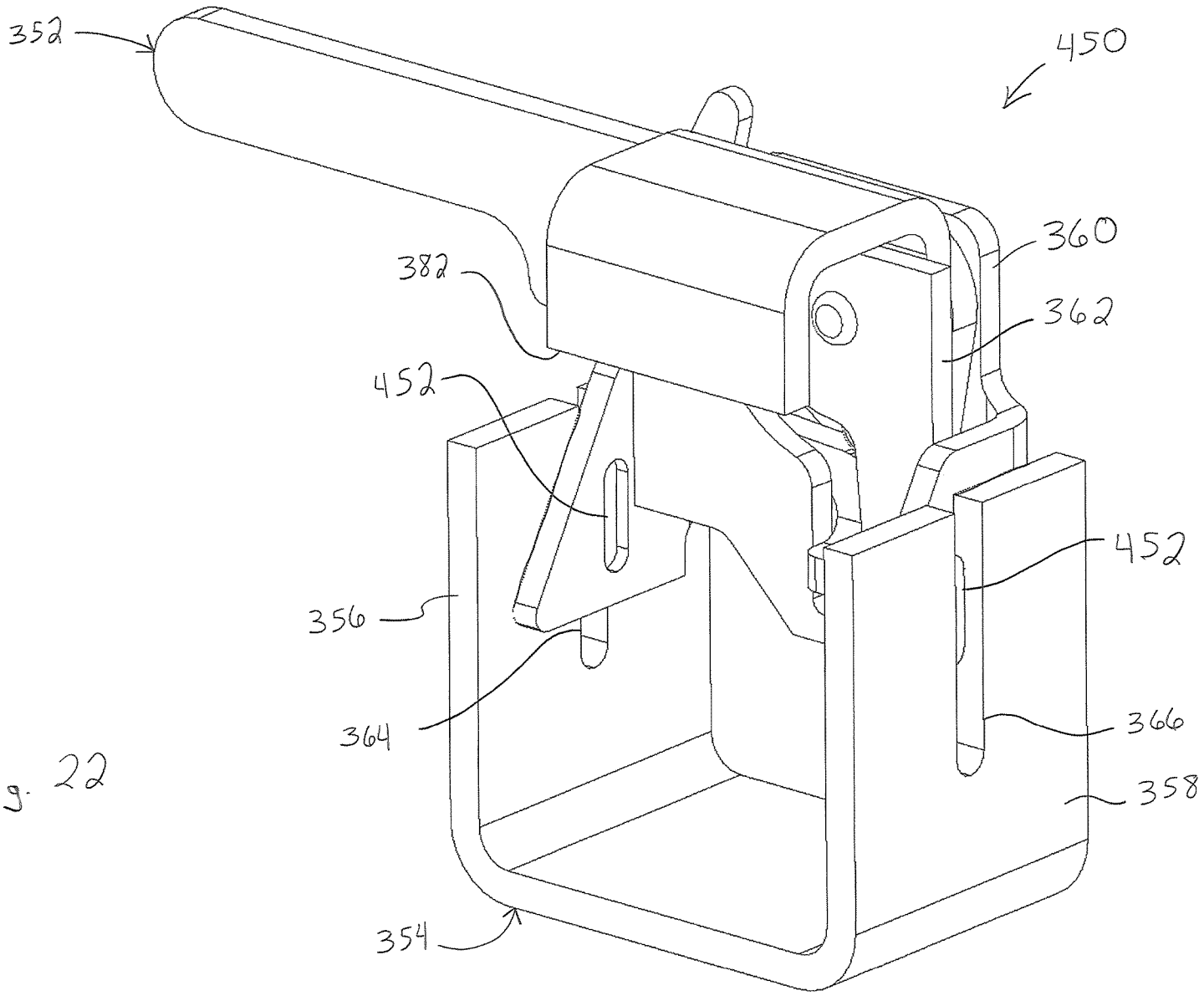
FIG. 22 is a perspective view of yet another exemplary system for locking and unlocking a hatch cover, according to an aspect of the present disclosure.
Figure 23:
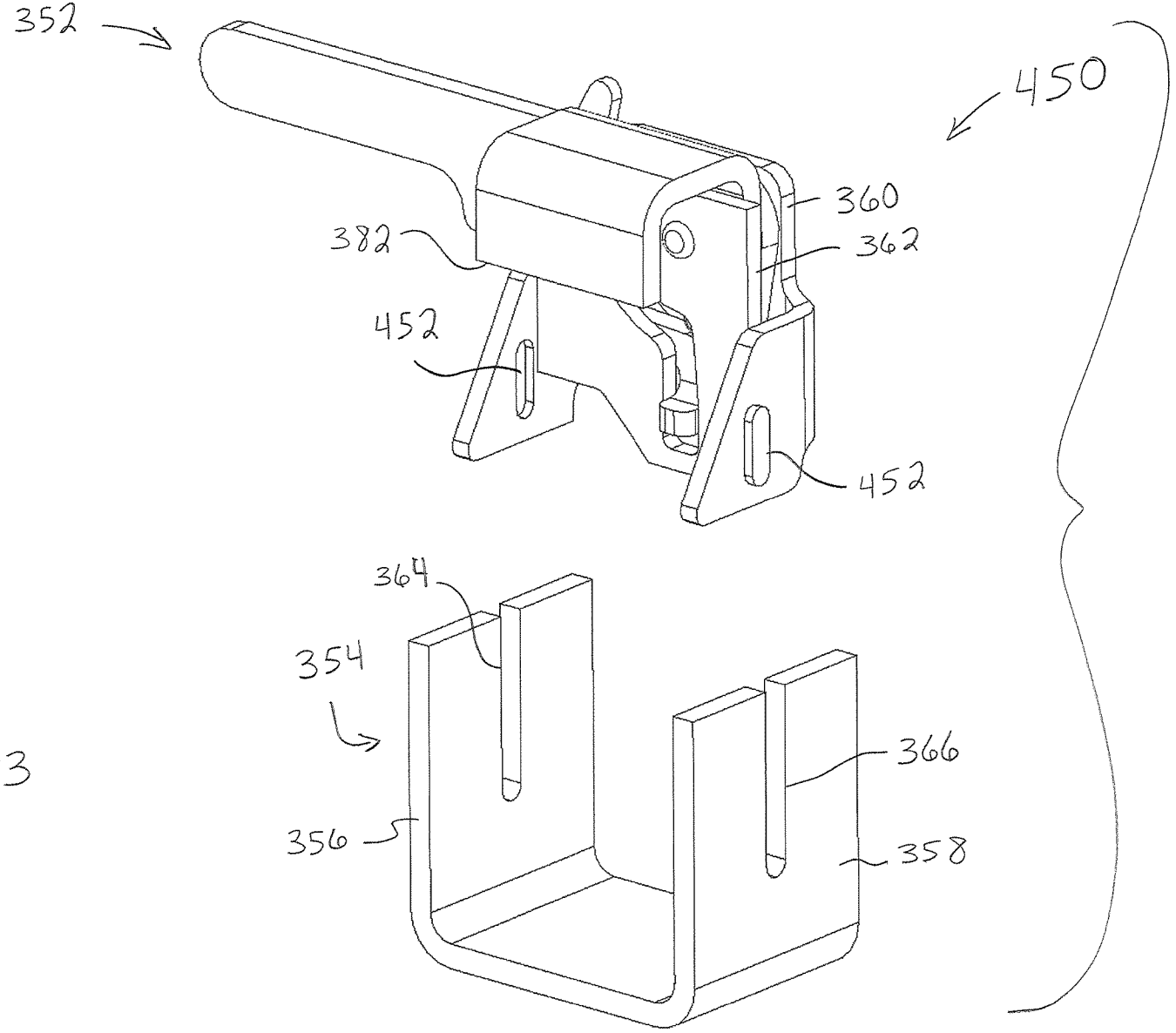
FIG. 23 is an exploded view of the system of FIG. 22.

FIGS. 22 and 23 show a system 450 that may be considered to be a variation of the system 400 of FIGS. 20 and 21, with the common components being similarly labeled. In the embodiment of FIGS. 22 and 23, the pair of protrusions configured to be received by a channel is replaced by a single, elongated, substantially vertically oriented protrusion 452. The elongated protrusions 452 of FIGS. 22 and 23 serve the same purpose as the pairs of protrusions of FIGS. 22 and 23, which is to be received by the respective channels 364 and 366 to allow for vertical adjustment of the position of the hatch cover lock 352 with respect to the mounting bracket 354 while preventing rotation of the hatch cover lock 352 with respect to the mounting bracket 354. As in the embodiment of FIGS. 20 and 21, with neither the hatch cover lock 352 nor the mounting bracket 354 being configured to accommodate a fastener assembly, the hatch cover lock 352 is instead welded or otherwise affixed to the mounting bracket 354 once the hatch cover lock 352 has been placed at the proper position or elevation. It is contemplated that a single mounting bracket 354 may be used in combination with different hatch cover locks at different times, with a removable hatch cover lock (as in FIGS. 18 and 19) being used initially, with that hatch cover lock later being removed and replaced with a differently configured hatch cover lock (e.g., one of the type shown in FIGS. 20-23).

Figure 24:
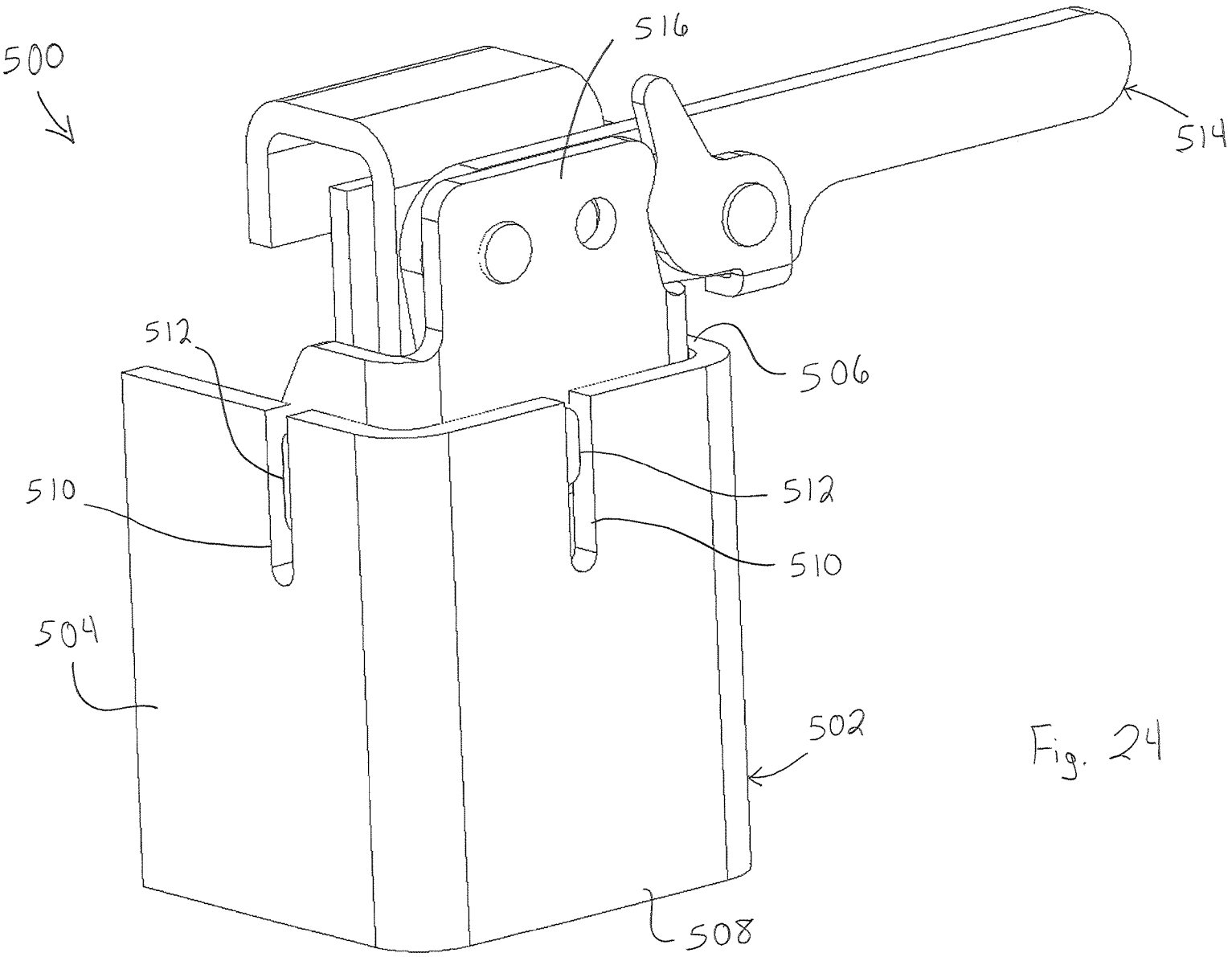
FIG. 24 is a perspective view of another exemplary system for locking and unlocking a hatch cover, according to an aspect of the present disclosure.
Figure 25:
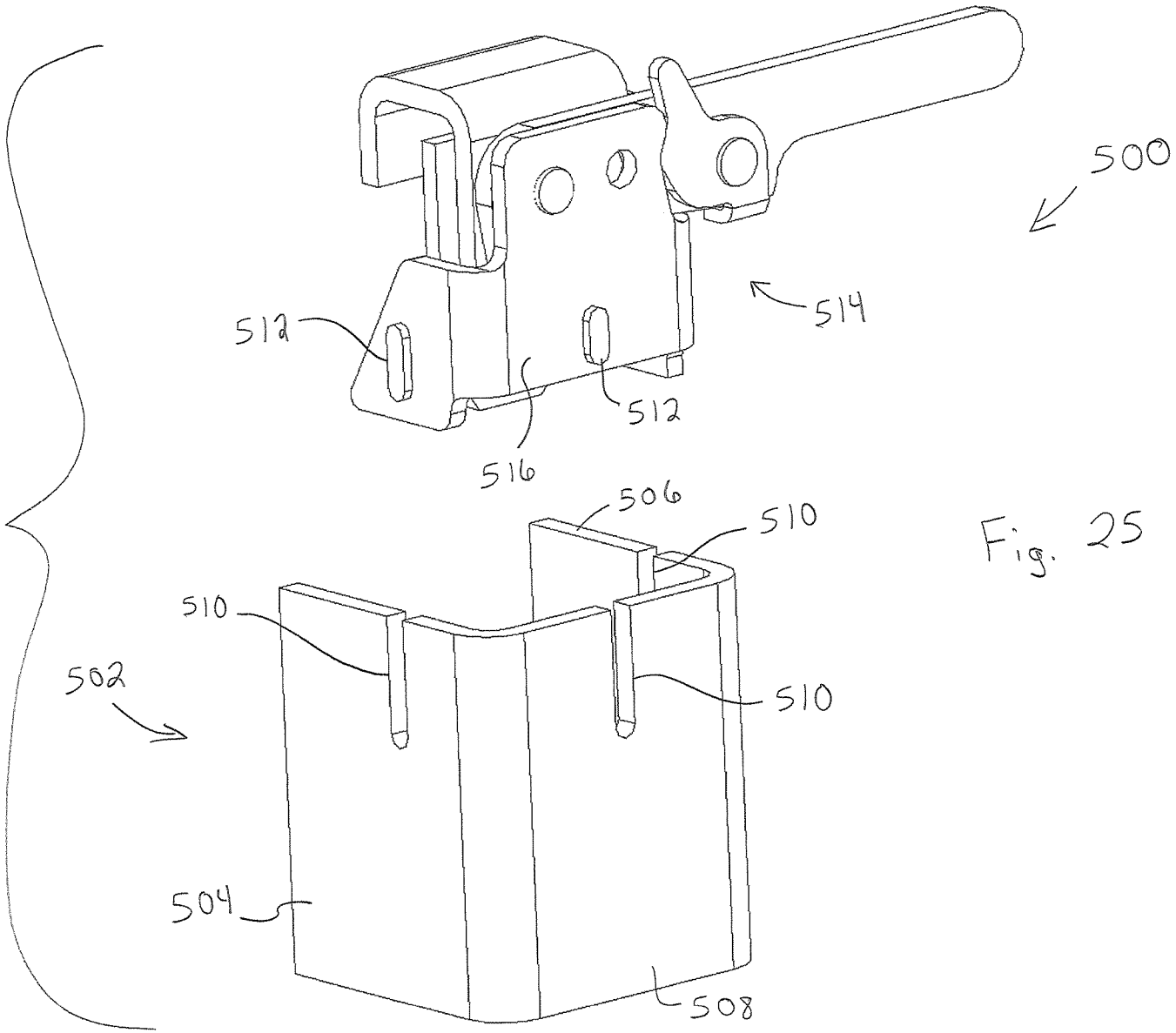
FIG. 25 is an exploded view of the system of FIG. 24.

FIGS. 24 and 25 show another possible variation of a system 500 for locking and unlocking a hatch cover of a railcar. In the embodiment of FIGS. 24 and 25, the mounting bracket 502 includes three legs or sidewalls 504, 506, and 508 instead of a pair of legs or sidewalls (as in the embodiments of FIGS. 18-23). In addition to two opposing legs or sidewalls 504 and 506, a third leg or sidewall 508 extends between the two opposing legs or sidewalls 504 and 506. Each of the illustrated sidewalls 504, 506, 508 includes a channel 510 configured to receive an associate protrusion 512 of the associated hatch cover lock 514, though it should be understood that one or more of the channels may instead be incorporated into the hatch cover lock 514, while one or more of the protrusions is incorporated into the mounting bracket 502.

In addition to the hatch cover lock 514 including a pair of lateral protrusions 512 (only one of which is visible in FIGS. 24 and 25), the hatch cover lock 514 includes an additional protrusion 512 associated with a rear surface (i.e., the outer flange 516) of the hatch cover lock 514. While FIGS. 24 and 25 show all of the protrusions 512 as being elongated (as in the embodiment of FIGS. 22 and 23), it should be understood that a single elongated protrusion may be replaced with a smaller protrusion and fastener-receiving aperture (as in the embodiment of FIGS. 18 and 19) or a pair of smaller protrusions (as in the embodiment of FIGS. 20 and 21). Regardless of the particular configuration of the protrusions and/or apertures, the hatch cover lock 514 is associated to the mounting bracket 502 as described above with respect to the embodiments of FIGS. 18-23, except with the rear protrusion 512 being received by the channel 510 of the rear leg or sidewall 508 of the mounting bracket 502. If only protrusions 512 are provided (as in the illustrated embodiment), the hatch cover lock 514 is welded or otherwise affixed to the mounting bracket 502 once the hatch cover lock 514 is in the proper position. Otherwise, if fastener-receiving apertures are provided, the hatch cover lock 514 may be adjustably secured to the mounting bracket 502 using one or more fastener assemblies.

Compared to the embodiments of FIGS. 18-23, the system 500 of FIGS. 24 and 25 may require additional fasteners and/or welds to fully secure the hatch cover lock 514 to the mounting bracket 502, though it should be understood that this is not necessarily the case, as one of the protrusions 512 may be received by the associated channel 510 without securing the associated surface of the hatch cover lock 514 to the corresponding leg or sidewall of the mounting bracket 502. However, it will be seen that, if all three protrusion-bearing surfaces of the hatch cover lock 514 are secured to the corresponding legs or sidewalls of the mounting bracket 502, the hatch cover lock 514 may be more reliably secured to the mounting bracket 502 than may be possible when using a mounting bracket 354 having only a pair of legs or sidewalls.

While it may be advantageous (in terms of stability) for a mounting bracket to include at least two legs or sidewalls, it is within the scope of the present disclosure for a mounting bracket to include only one upstanding leg or sidewall. In such an embodiment, the single leg or sidewall is associated to a lateral or front or rear surface of a hatch cover lock, followed by that surface of the hatch cover lock being secured to the leg or sidewall (via one or more fastener assemblies or welds or the like). This may include the single leg or sidewall defining a plurality of parallel channels each configured to receive at least one protrusion and/or fastener assembly (or multiple protrusions or fastener-receiving apertures configured to pair with parallel channels defined in the associated hatch cover lock) for improved stability.

It will be understood that the embodiments and examples described above are illustrative of some of the applications of the principles of the present subject matter. Numerous modifications may be made by those skilled in the art without departing from the spirit and scope of the claimed subject matter, including those combinations of features that are individually disclosed or claimed herein. For these reasons, the scope hereof is not limited to the above description but is as set forth in the following claims, and it is understood that claims may be directed to the features hereof, including as combinations of features that are individually disclosed or claimed herein.

The invention claimed is:

1. A hatch cover lock for use in combination with a hatch cover of a railcar, comprising:

an inner flange defining an opening and a slot;

an outer flange defining an opening at least partially aligned with the opening of the inner flange;

a keeper at least partially positioned between the inner and outer flanges, adjacent to the inner flange, wherein the keeper includes a follower at least partially received within the slot of the inner flange, and the keeper defines an opening at least partially aligned with the openings of the inner and outer flanges;

a handle at least partially positioned between the keeper and the outer flange, wherein the handle includes a projection at least partially received within the opening of the keeper, and the handle defines an opening at least partially aligned with the openings of the inner flange, the outer flange, and the keeper;

a pivot member extending through the openings of the inner flange, the outer flange, the keeper, and the handle; and an adjustment plate secured to the keeper and including opposing upper and lower surfaces and at least one aperture or protrusion spaced a first distance from the upper surface and a second, different distance from the lower surface, wherein the handle and the keeper are configured for rotation about the pivot member with respect to the inner and outer flanges between an open condition and a closed condition, the keeper further comprises an arm including an inwardly extending portion and a downwardly extending portion, with a bottom end of the downwardly extending portion defining a batten bar contacting surface configured to contact a batten bar or a hatch cover tab of a hatch cover in the closed condition, the downwardly extending portion of the arm of the keeper defines at least one aperture receiving at least one fastener or protrusion for securing the adjustment plate to the downwardly extending portion of the arm of the keeper so as to provide an alternative batten bar contacting surface that contacts said batten bar or hatch cover tab in the closed condition and is spaced away from said batten bar or hatch cover tab in the open condition, and/or includes at least one projection received by at least one aperture defined in the adjustment plate for securing the adjustment plate to the downwardly extending portion of the arm of the keeper so as to provide the alternative batten bar contacting surface, and the adjustment plate is configured to be secured to the downwardly extending portion of the arm of the keeper in at least a first position or orientation with the upper surface of the adjustment plate facing upwardly and the lower surface facing downwardly and defining the alternative batten bar contacting surface at a first elevation, and a second position or orientation with the lower surface of the adjustment plate facing upwardly and the upper surface facing downwardly and defining the alternative batten bar contacting surface at a second, different elevation.

2. The hatch cover lock of claim 1, wherein said at least one aperture defined in the downwardly extending portion of the arm of the keeper includes first and second apertures positioned at different heights, the alternative batten bar contacting surface is placed at the first elevation when the adjustment plate is secured to the downwardly extending portion of the arm of the keeper using the first aperture, and the alternative batten bar contacting surface is placed at the second elevation when the adjustment plate is secured to the downwardly extending portion of the arm of the keeper using the second aperture.

3. The hatch cover lock of claim 1, wherein the adjustment plate includes first and second apertures positioned at different heights and each configured to receive said at least one fastener or protrusion for securing the adjustment plate to the downwardly extending portion of the arm of the keeper, the alternative batten bar contacting surface is placed at the first elevation when the adjustment plate is secured to the downwardly extending portion of the arm of the keeper using the first aperture, and the alternative batten bar contacting surface is placed at the second elevation when the adjustment plate is secured to the downwardly extending portion of the arm of the keeper using the second aperture.

4. The hatch cover lock of claim 1, wherein the adjustment plate includes opposing upper and lower surfaces, the alternative batten bar contacting surface is placed at the first elevation when the adjustment plate is secured to the downwardly extending portion of the arm of the keeper with the upper surface of the adjustment plate facing upwardly and the lower surface facing downwardly and defining the alternative batten bar contacting surface, and the alternative batten bar contacting surface is placed at the second elevation when the adjustment plate is secured to the downwardly extending portion of the arm of the keeper with the lower surface of the adjustment plate facing upwardly and the upper surface facing downwardly and defining the alternative batten bar contacting surface.

5. The hatch cover lock of claim 1, wherein said at least one aperture defined in the downwardly extending portion of the arm of the keeper includes first and second apertures positioned at different heights, the adjustment plate includes first and second apertures positioned at different heights and each configured to receive said at least one fastener or protrusion for securing the adjustment plate to the downwardly extending portion of the arm of the keeper, the adjustment plate includes opposing front and rear surfaces and opposing upper and lower surfaces, and the elevation of the alternative batten bar contacting surface depends on which of the apertures of the adjustment plate and of the downwardly extending portion of the arm of the keeper are used to secure the adjustment plate to the downwardly extending portion of the arm of the keeper using the first aperture, which of the front and rear surfaces of the adjustment plate is facing the keeper when the adjustment plate is secured to the downwardly extending portion of the arm of the keeper, and which of the upper and lower surfaces of the adjustment plate is facing upwardly when the adjustment plate is secured to the downwardly extending portion of the arm of the keeper.

6. The hatch cover lock of claim 1, wherein said at least one aperture defined in the downwardly extending portion of the arm of the keeper comprises an elongated slot, the alternative batten bar contacting surface is placed at the first elevation when the adjustment plate is secured to the downwardly extending portion of the arm of the keeper with said at least one fastener or protrusion received at a first position within the elongated slot, and the alternative batten bar contacting surface is placed at the second elevation when the adjustment plate is secured to the downwardly extending portion of the arm of the keeper with said at least one fastener or protrusion received at a second position within the elongated slot.

7. The hatch cover lock of claim 1, wherein the adjustment plate includes at least one elongated slot configured to receive said at least one fastener or protrusion for securing the adjustment plate to the downwardly extending portion of the arm of the keeper, the alternative batten bar contacting surface is placed at the first elevation when the adjustment plate is secured to the downwardly extending portion of the arm of the keeper with said at least one fastener or protrusion received at a first position within the elongated slot, and the alternative batten bar contacting surface is placed at the second elevation when the adjustment plate is secured to the downwardly extending portion of the arm of the keeper with said at least one fastener or protrusion received at a second position within the elongated slot.

8. The hatch cover lock of claim 1, wherein said at least one aperture defined in the downwardly extending portion of the arm of the keeper comprises an elongated slot, the adjustment plate includes an elongated slot configured to receive said at least one fastener or protrusion for securing the adjustment plate to the downwardly extending portion of the arm of the keeper, the alternative batten bar contacting surface is placed at the first elevation when the adjustment plate is secured to the downwardly extending portion of the arm of the keeper with said at least one fastener or protrusion received at a first position within the elongated slots of the adjustment plate and the downwardly extending portion of the arm of the keeper, and the alternative batten bar contacting surface is placed at the second elevation when the adjustment plate is secured to the downwardly extending portion of the arm of the keeper with said at least one fastener or protrusion received at a second position within the elongated slots of the adjustment plate and the downwardly extending portion of the arm of the keeper.

9. The hatch cover lock of claim 1, wherein the adjustment plate includes an outer perimeter, and the adjustment plate is configured to be rotated about an axis of rotation to orient different regions of the outer perimeter of the adjustment plate downwardly, with the downwardly oriented region of the outer perimeter of the adjustment plate defining the alternative batten bar contacting surface.

10. The hatch cover lock of claim 9, further comprising at least one aperture defined in the adjustment plate and configured to receive said at least one fastener or protrusion for securing the adjustment plate to the downwardly extending portion of the arm of the keeper.

11. A hatch cover lock for use in combination with a hatch cover of a railcar, comprising:

an inner flange defining an opening and a slot;

an outer flange defining an opening at least partially aligned with the opening of the inner flange;

a keeper at least partially positioned between the inner and outer flanges, adjacent to the inner flange, wherein the keeper includes a follower at least partially received within the slot of the inner flange, and the keeper defines an opening at least partially aligned with the openings of the inner and outer flanges;

a handle at least partially positioned between the keeper and the outer flange, wherein the handle includes a projection at least partially received within the opening of the keeper, and the handle defines an opening at least partially aligned with the openings of the inner flange, the outer flange, and the keeper;

an adjustment plate having an outer perimeter including a plurality of edges; and a pivot member extending through the openings of the inner flange, the outer flange, the keeper, and the handle, wherein the handle and the keeper are configured for rotation about the pivot member with respect to the inner and outer flanges between an open condition and a closed condition, the keeper further comprises an arm including an inwardly extending portion and a downwardly extending portion, with a bottom end of the downwardly extending portion defining a batten bar contacting surface configured to contact a batten bar or a hatch cover tab of a hatch cover in the closed condition, a plurality of apertures are defined in the adjustment plate, with each aperture defined in the adjustment plate corresponding to a different one of the edges of the outer perimeter of the adjustment plate, the downwardly extending portion of the arm of the keeper defines at least one aperture configured to receive at least one fastener to secure the adjustment plate to the downwardly extending portion of the arm of the keeper, and the adjustment plate is configured to be rotated about an axis of rotation to align one of the apertures defined in the adjustment plate with said at least one aperture defined in the downwardly extending portion of the arm of the keeper and to downwardly orient the edge of the outer perimeter of the adjustment plate corresponding to said one of the apertures defined in the adjustment plate, with the downwardly oriented edge of the outer perimeter of the adjustment plate defining an alternative batten bar contacting surface and with each edge of the adjustment plate configured to place the alternative batten bar contacting surface at a different elevation.

12. A hatch cover lock for use in combination with a hatch cover of a railcar, comprising:

an inner flange defining an opening and a slot;

an outer flange defining an opening at least partially aligned with the opening of the inner flange;

a keeper at least partially positioned between the inner and outer flanges, adjacent to the inner flange, wherein the keeper includes a follower at least partially received within the slot of the inner flange, and the keeper defines an opening at least partially aligned with the openings of the inner and outer flanges;

a handle at least partially positioned between the keeper and the outer flange, wherein the handle includes a projection at least partially received within the opening of the keeper, and the handle defines an opening at least partially aligned with the openings of the inner flange, the outer flange, and the keeper;

an adjustment plate having an outer perimeter; and a pivot member extending through the openings of the inner flange, the outer flange, the keeper, and the handle, wherein the handle and the keeper are configured for rotation about the pivot member with respect to the inner and outer flanges between an open condition and a closed condition, the keeper further comprises an arm including an inwardly extending portion and a downwardly extending portion, with a bottom end of the downwardly extending portion defining a batten bar contacting surface configured to contact a batten bar or a hatch cover tab of a hatch cover in the closed condition, the downwardly extending portion of the arm of the keeper defines at least one aperture configured to receive at least one fastener to secure the adjustment plate to the downwardly extending portion of the arm, the adjustment plate is configured to be rotated about an axis of rotation to orient different regions of the outer perimeter of the adjustment plate downwardly, with the downwardly oriented region of the outer perimeter of the adjustment plate defining an alternative batter bar contacting surface, and one of the adjustment plate and the downwardly extending portion of the arm of the keeper includes a projection configured to be received by an aperture defined in the other one of the adjustment plate and the downwardly extending portion of the arm of the keeper, said projection defining the axis of rotation.

* * * * *